US009176414B2

(12) United States Patent
Sato et al.

(10) Patent No.: US 9,176,414 B2
(45) Date of Patent: Nov. 3, 2015

(54) CHARGING DEVICE AND IMAGE FORMING APPARATUS

(71) Applicant: CANON KABUSHIKI KAISHA, Tokyo (JP)

(72) Inventors: Shun Sato, Ashigarakami-gun (JP); Daisuke Baba, Mishima (JP); Shuhei Kawasaki, Susono (JP); Makoto Tokudome, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/315,882

(22) Filed: Jun. 26, 2014

(65) Prior Publication Data

US 2015/0003873 A1 Jan. 1, 2015

(30) Foreign Application Priority Data

Jul. 1, 2013 (JP) ..... 2013-137917
Jul. 2, 2013 (JP) ..... 2013-138746
May 20, 2014 (JP) ..... 2014-104247

(51) Int. Cl.
*G03G 15/02* (2006.01)

(52) U.S. Cl.
CPC ..... *G03G 15/0208* (2013.01); *G03G 15/0233* (2013.01)

(58) Field of Classification Search
CPC combination set(s) only.
See application file for complete search history.

(56) References Cited

U.S. PATENT DOCUMENTS

2002/0021917 A1 2/2002 Ishiyama et al.
2003/0219282 A1* 11/2003 Satoh et al. ..... 399/174
2010/0135695 A1 6/2010 Mayuzumi et al.
2011/0002711 A1* 1/2011 Wada ..... 399/176
2012/0076539 A1* 3/2012 Sato et al. ..... 399/174

FOREIGN PATENT DOCUMENTS

EP 0 580 159 A2 1/1994
JP 02-198467 A 8/1990
JP H04-309972 A 11/1992
JP 05-181349 A 7/1993
JP 2002-341626 A 11/2002
JP 2003-302809 A 10/2003

OTHER PUBLICATIONS

European Search Report dated Oct. 31, 2014, in related European Patent Application No. 14172668.7.

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A charging device for electrically charging a photosensitive member includes a charging member for electrically charging the photosensitive member by being supplied with a voltage, and a supporting member for supporting the charging member so as to press-contact to the photosensitive member. The charging member includes an electroconductive support, an elastic base layer supported by the electroconductive support, and an elastic surface layer, provided on a surface of the elastic base layer, being harder than the elastic base layer. The elastic surface layer is provided with projected portions and recessed portions. The projected portions are elastically deformable in contact with the photosensitive member, leaving electrically dischargeable gaps between the recessed portions of the elastic surface layer and the photosensitive member.

29 Claims, 15 Drawing Sheets

| | MATERIAL | Rz | HARDNESS |
|---|---|---|---|
| 1ST EMB. | ER | 26 | 64 DEG. |
| 1ST COMP.EX. | ER | 5 | 45 DEG. |
| 2ND COMP.EX. | ER + SPACER | 5 | 45 DEG. |
| 3RD COMP.EX. | FOAM | | 30 DEG. |
| 2ND EMB. | ER | 26 | 64 DEG. |
| 3RD EMB. | ER | 26 | 64 DEG. |

" ER " : ELECTROCONDUCTIVE RESIN

Fig. 9

| | $L(1-P/EP)>7.7\times10^{-6}m$ | REGION | DAMAGE | SET |
|---|---|---|---|---|
| 1ST EMB. | ○ | ○ | ○ | ○ |
| 1ST COMP.EX. | × | × | ○ | ○ |
| 2ND COMP.EX. | ○ | ○ | × | ○ |
| 3RD COMP.EX. | ○ | ○ | ○ | × |
| 2ND EMB. | ○ | ○ | ○ | ○ |
| 3RD EMB. | ○ | ○ | ○ | ○ |

Fig. 10

CHARGING DEVICE AND IMAGE FORMING APPARATUS

FIELD OF THE INVENTION AND RELATED ART

The present invention relates to a charging device and an image forming apparatus including the charging device.

An electrophotographic image forming apparatus such as a copying machine or a laser beam printer forms an electrostatic image (latent image) by irradiating a uniformly charged electrophotographic photosensitive member with light corresponding to image data. Then, to the latent image, a toner as a developer which is a material for recording is supplied from a developing device to visualize the latent image as a toner image. This toner image is transferred from the member onto a recording material (medium) such as a recording sheet by a transfer device, and then is fixed on the recording material by a fixing device, so that a recording image is formed. The surface of the photosensitive member after separation of the recording material is cleaned by scraping off a transfer residual toner by a cleaning device, and then is repeatedly subjected to image formation.

As a method of electrically charging the photosensitive member surface, from the viewpoints of a low voltage process, a low ozone generation amount, downsizing and the like, there are methods of a roller type, a blade type and the like. These methods are a contact charging method in which the photosensitive member surface is electrically charged by bringing a charging member into contact with the surface of the photosensitive member as a member to be charged and then by applying a voltage to the charging member.

Due to an increasing demand for speed-up of the image forming apparatus in recent years, a process speed becomes high, so that a high charging performance in a short time has been required for the charging member. In order to solve such a problem, there is a method in which a frequency or peak-to-peak voltage of an applied voltage is increased. However, in the method described above, there was a problem such that electric power consumption became high. Further, there is also a method using a plurality of charging members, but there were problems of increases in cost and size.

As a means for solving such problems, there is a method in which an electrical discharge is increased to obtain a high charging property. In this method, electric discharge is generated at a contact nip between the photosensitive member and the charging member and thus it is possible to obtain the high charging property by a simple constitution without increasing the electric power consumption.

For this reason, in Japanese Laid-Open Patent Application (JP-A) 2002-341626, a spacer is provided between a photosensitive member and a charging member, and thus an electrically dischargeable gap is maintained at a contact nip between the photosensitive member and the charging member, so that a discharging region is increased to enable obtaining of a high charging property.

Further, in JP-A Hei 5-181349, a foam member is used as a surface layer charging member to cause electric discharge in cells of the foam member at a contact nip, so that a discharging region is increased to enable obtaining a high charging property.

Further, in JP-A Hei 5-181349, a foam member is used as a surface layer charging member to cause electric discharge in cells of the foam member at a contact nip, so that a discharge is increased thereby to enable obtaining of a high charging property.

However, in JP-A 2002-341626, the spacer for maintaining the contact nip between the photosensitive member and the charging member is harder than the photosensitive member, so that there was the case where the spacer damages the photosensitive member surface. As a result, charging non-uniformity due to the damage was generated, and thus a vertical stripe was generated on an image.

Further, in JP-A Hei 5-181349, the foam member is used as the surface layer, and therefore when the photosensitive member and the charging member are in contact with each other for a long term, there is the case where the foam member is changed in shape (set) to cause charging non-uniformity (non-uniformity of a potential of the photosensitive member after the charging) at that portion. In the case where an image is formed on the photosensitive member where the potential is non-uniform, there is a possibility that also an image density becomes non-uniform. Specifically, there is a possibility that a portion different in density from a peripheral portion (i.e., a lateral stripe portion extending in a longitudinal direction of the photosensitive member) is generated on the image at the same frequency as a rotation cycle of a charging roller.

SUMMARY OF THE INVENTION

The present invention has been accomplished in view of the above-described problems. A principal object of the present invention is to obtain a high charging property by increasing an electrically discharging region while maintaining an image quality when a photosensitive member is electrically charged.

According to an aspect of the present invention, there is provided a charging device for electrically charging a photosensitive member, comprising: a charging member for electrically charging the photosensitive member by being supplied with a voltage; and a supporting member for supporting the charging member so as to press-contact to the photosensitive member, wherein the charging member comprises: an electroconductive support; an elastic base layer supported by the electroconductive support; and an elastic surface layer, provided on a surface of the elastic base layer, being harder than the elastic base layer; wherein said elastic surface layer is provided with projected portions and recessed portions, and wherein the projected portions are elastically deformable in contact with the photosensitive member, leaving electrically dischargeable gaps between the recessed portions of the elastic surface layer and the photosensitive member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9 is a table showing physical properties of charging rollers in First to Third Comparison Examples and First to Third Embodiments.

FIG. 10 is a table showing a result of comparison of the charging rollers in First to Third Comparison Examples and First to Third Embodiments.

DESCRIPTION OF THE EMBODIMENTS

Embodiments of the present invention will be described with reference to the drawings. However, relative arrangements, display drawings and the like of constituent elements in the following embodiments are not intended to be to the effect that the scope of the present invention is limited only thereto unless otherwise particularly specified.

Incidentally, herein, with respect to a structure and operation of a process cartridge, terms, such as upper, lower, right and left, indicating directions represent associated directions as seen in an ordinary working state unless otherwise specified. That is, the normal working state of the process cartridge is a state in which the process cartridge is properly mounted in a properly disposed image forming apparatus and is capable of being subjected to an image forming operation.

<First Embodiment>

(General Structure of Image Forming Apparatus)

Figure 1:
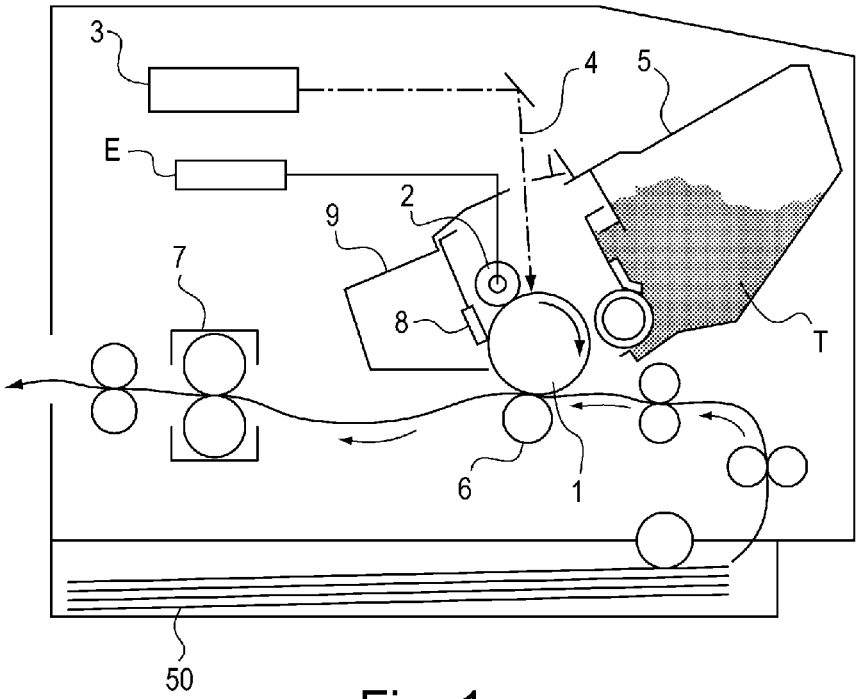
FIG. 1 is a schematic illustration of an image forming apparatus.

FIG. 1 is a schematic structural view of an image forming apparatus in this embodiment according to the present invention. A contact charging member in this embodiment will be described later. The image forming apparatus in this embodiment is a laser beam printer for effecting electrophotographic image formation.

As shown in FIG. 1, a photosensitive drum 1 (an OPC (organic photoconductor) photosensitive drum having a diameter of 24 mm) rotationally driven at a predetermined process speed is electrically charged uniformly to −560 V at a surface thereof by a charging roller 2. An applied voltage to the charging roller 2 is a superposed oscillating voltage including a DC component of −560 V and an AC component (sine wave of 1400 Hz in frequency and 160 Vpp in peak-to-peak voltage). Incidentally, the photosensitive drum is a photosensitive member (electrophotographic photosensitive member) having a hollow cylindrical shape (drum shape).

The electrically charged photosensitive drum 1 is then subjected to scanning exposure 4 to laser light outputted, from a laser scanner 3, after being modulated in intensity in accordance with a time-series electric digital pixel signal of an objective image information. As a result, electric charges at a scanning exposure portion of the surface of the photosensitive drum 1 is removed to provide a voltage of about −130 V, so that an electrostatic latent image corresponding to the objective image information is successively formed on the surface of the photosensitive drum 1.

The formed latent image is visualized as a toner image by a developing device 5. In this embodiment, the developing device 5 is a reversal developing device using a magnetic one-component negative toner, and a developing method (type) is a jumping developing method. The latent image is developed (reversely developed) by deposition of the toner on a low potential portion. The photosensitive drum 1 is an image bearing member for bearing the image (toner image or latent image) at the surface thereof.

To a transfer 6, a transfer bias for transfer is applied. Further, a recording material (medium) P is fed from a feeding portion at predetermined timing to a press-contact nip (transfer portion) between the photosensitive drum 1 and the transfer roller 6. Then, at this transfer portion, the toner image on the surface of the photosensitive drum 1 is transferred onto the recording material P such as paper. The recording material P on which the toner image is transferred is fixed by a fixing device 7, and then is outputted.

Further, from the surface of the photosensitive drum 1 after the transfer of the toner image therefrom, a residual deposited matter such as a transfer residual toner is removed, and then the surface of the photosensitive drum 1 is subjected repeatedly to image formation.

In this embodiment, the photosensitive drum 1, the charging roller 2, the developing device 5 and a cleaning device 9 form the process cartridge as a unit, and this process cartridge is detachably mountable to an image forming apparatus main assembly. This process cartridge may only be required to include at least the photosensitive drum 1 and the charging roller 2.

(Structure of Photosensitive Drum)

The photosensitive drum 1 is of a reversal development type in which an aluminum cylinder is coated with a 18

μm-thick OPC layer, and an outermost layer thereof is a charge-transporting layer including modified polycarbonate as a binder resin.

(Structure of Charging Roller)

Then, the charging roller 2 (charging member) which is a characteristic feature of this embodiment will be described.

Figure 2:
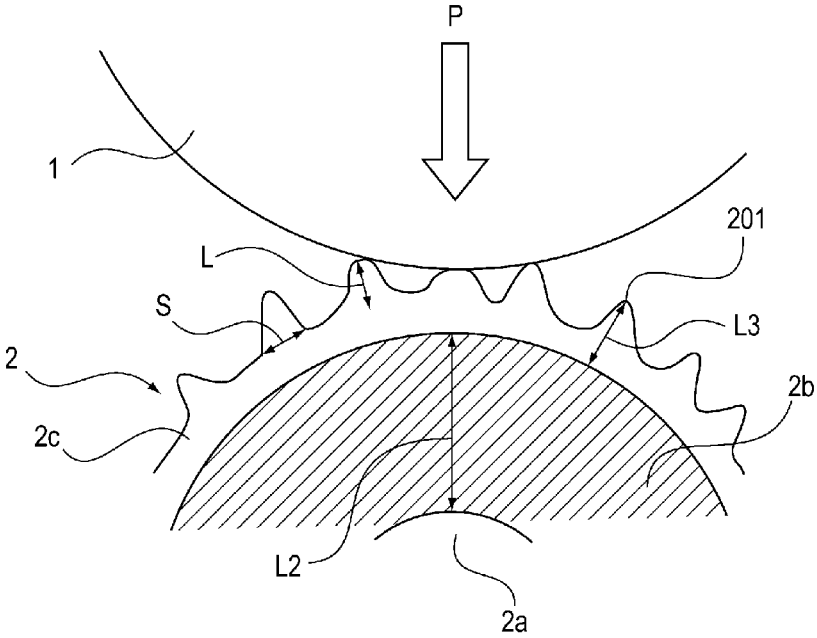
FIG. 2 is a schematic view showing a shape of a charging roller.

FIG. 2 is a schematic view showing a shape of the charging roller 2.

As shown in FIG. 2, the charging roller 2 in this embodiment includes an Electroconductive support 2*a*, an electroconductive elastic layer 2*b* (elastic layer) formed at an outer peripheral surface of the electroconductive support 2*a*, and a surface layer 2*c* (elastic surface layer) coating an outer peripheral surface of the electroconductive elastic layer 2*b*. As a material for the electroconductive support 2*a*, metal was used.

The electroconductive elastic layer 2*b* was formed in a roller shape concentrically integral with the electroconductive support 2*a* at the outer peripheral surface of the electroconductive support 2*a* by using a mixture of an electroconductive agent and a polymeric elastic member. Further, after the electroconductive elastic layer 2*b* is prepared, the surface layer 2*c* as a coating layer was provided.

As the electroconductive agent, an ion conductive agent such as quaternary ammonium salt or an electron conductive agent such as carbon black is used. Further, as the polymeric elastic member, e.g., epichlorohydrin rubber, acrylonitrile rubber, urethane rubber, epichlorohydrin-acrylonitrile-butadiene rubber, styrene butadiene rubber and so on are used. Further, by subjecting the surface of the electroconductive elastic layer 2*b* to curing by heating, light irradiation, electron beam irradiation or the like, it is possible to form a thin surface layer 2*c* on the surface of the electroconductive elastic layer 2*b*. Alternatively, onto the surface of the electroconductive elastic layer 2*b*, a substance for forming the surface layer 2*c* may also be applied.

Incidentally, the surface layer 2*c* of the charging roller 2 is provided with a plurality of minute projections (projected portions) 201. By these (plurality of) minute projections 201, the surface layer 2*c* is provided with projected portions and recessed portions (uneven portions).

A height of the minute projections 201 when the minute projections do not contact the photosensitive drum 1 (i.e., before elastic deformation) is L (m). The sum of areas of the plurality of minute projections 201 contacting the photosensitive drum 1 is S ($m^2$). That is, the plurality of minute projections 201 contact the photosensitive drum 1 in an electrically discharge between the photosensitive drum 1 and the charging roller 2, and therefore the sum of areas of all the contact portions therebetween is S. Further, Young's modulus of the charging roller 2 is E (MPa). Incidentally, the Young's modulus of the charging roller 2 refers to the Young's modulus E when an elastic portion of the charging roller 2 is deformed. That is, the Young's modulus of a combined layer of the electroconductive elastic layer 2*b* and the surface layer 2*c* is measured. Further, an urging force for urging the charging roller 2 in a direction toward the photosensitive drum 1 is P (N). In this embodiment, as described later, the charging roller 2 is urged (pressed) by two urging springs 31 (FIG. 3), and therefore a total of forces of these two springs is P. At this time, the feature of the charging member is such that these parameters satisfy the following formula (1):

$$((V)-312)/6.2)\times10^{-6}(m)>L(1-P/ES)>7.7\times10^{-6}(m) \quad \text{(formula 1).}$$

That is, the minute projections 201 are elastically deformable when they are press-contacted to the photosensitive drum 1, and when a charging bias is applied in an elastically deformed state, the minute projections 201 form an electrically dischargeable gap in all the regions where the minute projections 201 are press-contacted to the photosensitive drum 1.

The present inventors have found that there is a need to satisfy the formula 1 in order to maintain the dischargeable gap at a contact nip with the photosensitive drum 1. As a result, the electric discharge is enabled at the contact nip, so that it is possible to provide a charging member and a charging device which are capable of obtaining a high charging property.

Incidentally, the formula 1 will be described later in detail.

(Positional Relationship Between Charging Roller and Photosensitive Drum)

Figure 3:
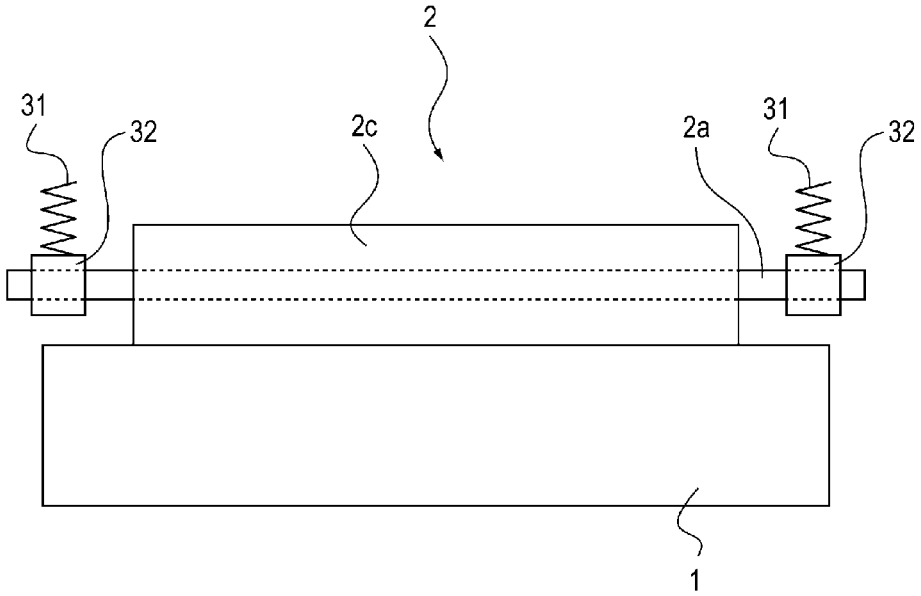
FIG. 3 is a schematic front view of the charging roller and a photosensitive drum.

FIG. 3 is a schematic front view of the charging roller 2 and the photosensitive drum 1.

As shown in FIG. 3, the charging roller 2 is a roller member rotatably supported by a bearing member (supporting member) 32 at each of end portions of the electroconductive support 2*a*. Then, the charging roller 2 is urged toward the photosensitive drum 1 by the urging spring (urging member) 31 mounted on the bearing member 32, thus being press-contacted to the surface of the photosensitive drum 1 at a predetermined urging force (500 gram-weight). The charging roller 2 is rotated by rotation of the photosensitive drum 1. Then, a predetermined charging bias is applied from a power source E to the charging roller 2 via the electroconductive support 2*a* as shown in FIG. 1, so that the peripheral surface of the photosensitive drum 1 is electrically charged to a predetermined potential. That is, in FIG. 3, a structure of a charging device for charging the photosensitive drum is shown.

(Calculation of Electrically Dischargeable Gap)

Next, the electrically dischargeable gap by the minute projections 201 will be described.

The electric discharge generated at a minute gap is described in general by Paschen's law. The Paschen's law shows an electric discharge start voltage at the minute gap, i.e., a dielectric breakdown voltage Vz at an air layer, and is represented by a function Vg=f(p,d) of atmospheric pressure p and a distance d of the minute gap.

Figure 4:
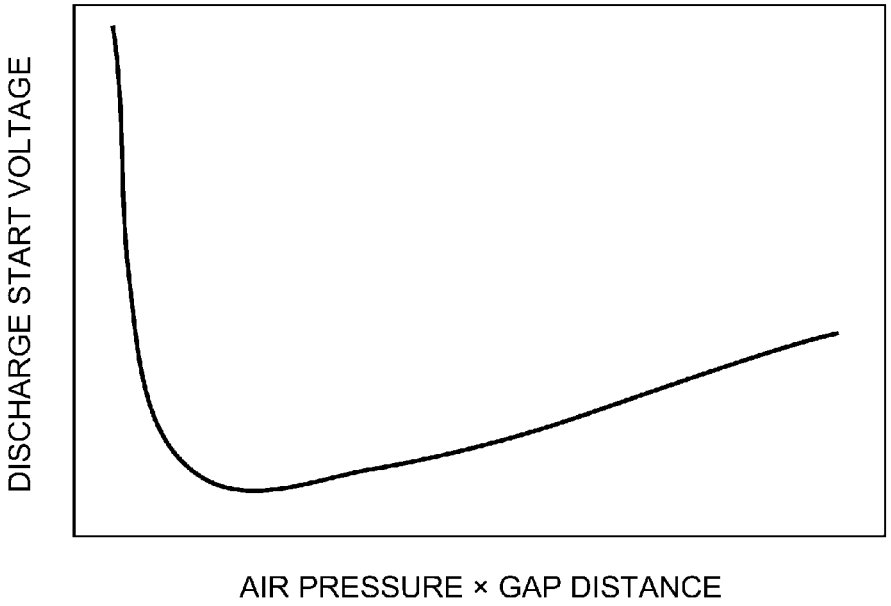
FIG. 4 is a graph showing a function of a discharge start voltage at a minute gap.

FIG. 4 is a graph showing the function of the discharge start voltage at the minute gap.

As shown in FIG. 4, a curve has a minimum and is linearly drawn after the minimum.

In the case of electrophotography, the image forming apparatus is used under atmospheric pressure, and therefore the discharge start voltage is represented by the function using only the gap distance d, and is represented by the formula shown below. Further, the minimum at this time is the distance $d=7.7\times10^{-6}$ (m) of the minute gap (reference: "Electrophotography-process and simulation", published by Tokyo Denki University Press, ISBN 978-4-501-32650-0).

Accordingly, from a position of the distance $d=7.7\times10^{-6}$ m or later positions, the dielectric breakdown voltage Vz can be represented by a linear equation shown below.

$$Vz=312+6.2\times10^{6}d \text{ (where } 7.7\times10^{-6}m<d)$$

Next, the dischargeable distance d between the photosensitive drum 1 and the charging roller 2 at an air gap G of the minute projections 201 is calculated. A voltage applied between the charging roller 2 and an electroconductive base layer of the photosensitive drum 1 is allocated between an electrostatic capacity C1 of a photosensitive layer (an OPC photosensitive layer of 3 in dielectric constant and 18 μm in thickness) and an electrostatic capacity C2 of a minute air gap G portion formed between the charging roller 2 and the photosensitive layer.

Specifically, each of the electrostatic capacity C1 of the photosensitive layer and the electrostatic capacity C2 of the air layer is, when the distance d is a thickness of the air layer and a unit thereof is μm, represented by the following formula.

$$C1=3\times8.85\times10^{-12}\times1/18\times10^{-6}$$

$$C2=1\times8.85\times10^{-12}\times1/d\times10^{-6}$$

On the other hand, the dielectric breakdown voltage Vz of the minute air layer is represented by the following formula under the atmospheric pressure on the basis of the Paschen's law.

$$Vz=312+6.2\times10^{6}d \text{ (where } 7.7\times10^{-6}m<d)$$

For this reason, there is need to satisfy:

$$((V-312)/6.2)\times10^{-6}m>d.$$

Further, under the atmospheric pressure, when the thickness of the air layer is 7.7 μm or less, the electric discharge is not generated based on the Paschen's law, and therefore when an applied voltage is V (V), a voltage Vair actually applied to the air layer is represented by:

$$Vair=\{C1/(C1+C2)\}\times V.$$

For this reason, the electric discharge is generated when Vair≥Vz. Therefore, a voltage of 1000 V is applied, the gap distance d of the dischargeable air gap G is d=7.7 μm to 102 μm, and when a voltage of 2000 V is applied, the gap distance d of the dischargeable air gap G is d=7.7 μm to 265 μm.

That is, the gap distance d during the contact between the photosensitive drum and the charging roller is required to satisfy: $d>7.7\times10^{-6}$ m.

(Gap Calculation During Contact)

Then, a condition satisfying the dischargeable distance at the contact nip during the contact will be described.

A height of the projected portions formed at the coating layer surface before the charging roller 2 is contacted to the photosensitive drum 1 is L (m). The sum of areas of the minute projected portions contacting the photosensitive drum 1 is S ($m_2$). That is, the plurality of minute projections 201 contact the photosensitive drum 1 in the electrically discharge formed by the charging roller 2 and the photosensitive drum 1, and therefore the sum of those contact between is S. Further, the Young's modulus of the charging roller 2 is E ($N/m_2$). Further, the urging force for urging the charging roller in the direction toward the member to be charged is P (N). In this case, with respect to the height of the minute projected portions formed at the outermost surface of the coating layer, the distance d is required to be $7.7\times10^{-6}$ m or more.

That is, when the height of the minute projections 201 in a free state is L and a deformation amount during the contact with the photosensitive member is λ, the gap distance d between the photosensitive member and the charging roller during the contact is d=L−λ.

Further, based on the Young's rule, a distortion ∈ is ∈=λ/L and a stress σ if σ=P−S, and therefore, the Young's modulus E is E=(P/s)×(L/λ).

Therefore, the following formula (2) is required to be satisfied.

$$d=L(1-P/ES)>7.7\times10^{-6}(m) \quad \text{(formula 2)}$$

In the above, d=L(1−P/ES) corresponds to the height of the minute projections 201 when the minute projections 201 are deformed by the contact with the photosensitive drum.

Figure 5:
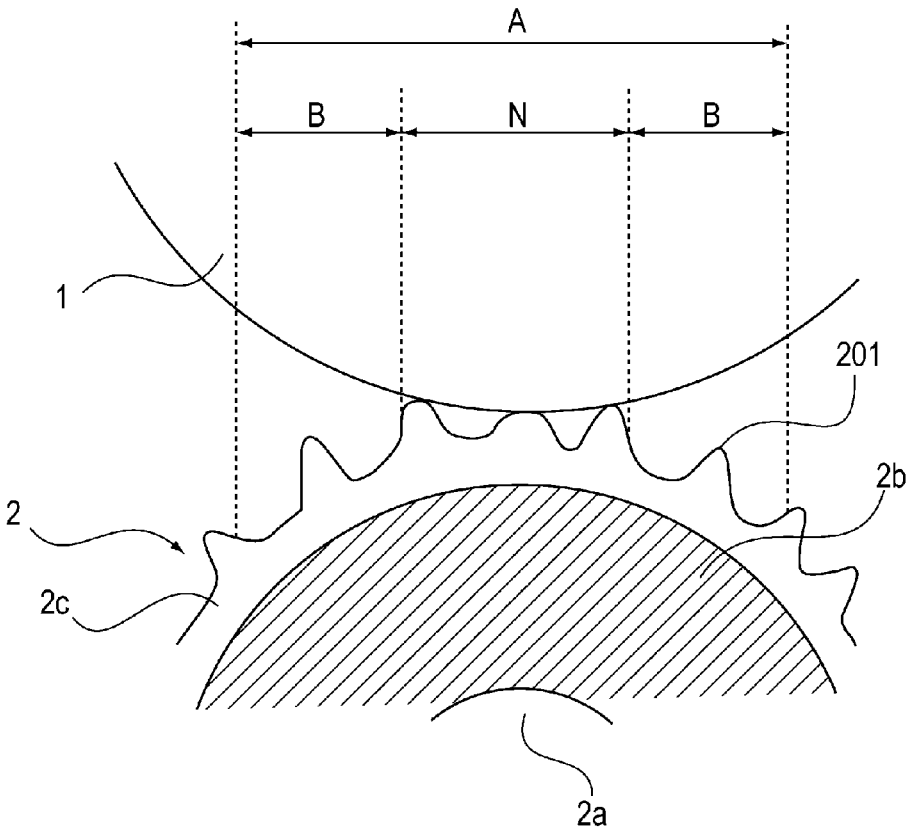
FIG. 5 is a schematic diagram of the photosensitive drum and the charging roller.

FIG. 5 is a schematic view of the discharging region between the photosensitive drum 1 and the charging roller 2.

When the formula 2 is satisfied, it is possible to obtain the discharging region as shown in FIG. 5. That is, as shown in FIG. 5, it is possible to generate the electric discharge in both a discharging region A at a contact nip N and discharging regions B at portions other than the contact nip N.

On the other hand, when the minute projections 201 are deformed at the contact nip N and thus the dischargeable distance d is $7.7\times10^{-6}$ m or less, the electric discharge is generated only in the discharging region B. That is, by satisfying the formula 2, a broad discharge is obtained, so that it is possible to obtain a high charging property.

(Surface Roughness of Charging Roller)

The surface layer 2*c* in this embodiment contains at least a surface layer binder and fine particles (having a volume-average particle size of 10-50 μm, preferably 20-40 μm) as a surface-roughening agent. The fine particles may be any of spherical particles or irregular-shaped particles. Further, an amount of the fine particles contained in the surface layer binder is 10-100 wt. %. Here, "wt. %" is a weight percentage, and specifically, the amount is obtained from the following calculation formula.

{(weight of fine particles)/(weight of surface layer binder)}×100

A ten point average roughness Rz (according to JIS 1994) of the surface of the charging roller 2 is Rz=15-50 μm, preferably Rz=20-30 μm. there are inconveniences such that a degree of image defect such as sandpaper-like defect is worse when a value of the roughness is high and that a noise generated during the charging becomes large when the value of the roughness is low. Incidentally, the sandpaper-like defect refers to deposition of the toner also at a portion (image background portion) where the toner image is not naturally intended to be formed at a portion of the surface of the photosensitive drum 1, as a result that a degree of the charging of the photosensitive drum 1 by the charging roller 2 is insufficient. The toner deposited on the image back ground portion appears to be the sandpaper-like defect, and therefore such an image defect is referred to as the sandpaper-like defect.

In this embodiment, the surface roughness Rz of the charging roller 2 is Rz=26 μm. The surface roughness Rz was measured by using a surface roughness meter ("Surfcom 1400A", manufactured by Tokyo Seimitsu Co., Ltd.) under a condition of 8.0 mm in measurement length, 0.8 mm in cut-off value, and 0.3 mm/sec in measurement speed.

Further, in this embodiment, the Young's modulus E of the layer as the sum of the electroconductive elastic layer 2*b* and the surface layer 2*c* of the charging roller 2 may preferably be 10-150 MPa. Incidentally, the Young's modulus E is measured in a standard environment in which the image forming apparatus is used, specifically in an environment of 23° C. in temperature and 60% RH in relative humidity.

Incidentally, the Young's modulus E of the charging roller 2 was calculated from a distortion amount after a load, of 100 $mN/mm^2$ applied in 1 minute by a universal hardness meter (a surface film physical property testing machine "Fishcerscope H100C", manufactured by Fischer Instruments K.K.), reaches 100 $mN/mm^2$. The Young's modulus E of the charging roller used in this embodiment was 20 MPa.

(Dimension of Charging Roller)

The dimension of the charging roller 2 is as follows.

Diameter of electroconductive support: 6 mm

Thickness L2 of electroconductive elastic layer 2*b*: about 1.5 mm

Thickness L3 of surface layer 2*c*: about 10 μm

Here, the thickness L2 of the surface layer 2*c* is a length from the surface of the electroconductive elastic layer 2*b* to a top point of the minute projections 201. For that reason, L3>L>d holes. Accordingly, from the formula 2, L3 is required to be larger than $7.7\times10^{-6}$ m. Further, the surface layer 2*c* is a thinner layer than the electroconductive elastic layer 2*b*. The surface layer 2*c* has a hardness higher (harder) than the electroconductive elastic layer 2*b* although described later. For that reason, when the surface layer 2*c* is excessively thin, the surface of the charging roller 2 is also excessively hard, so that when the photosensitive drum 1 is rotated in contact with the charging roller 2, the surface of the photosensitive drum 1 is largely abraded (worn).Therefore, in this embodiment, the thickness of the surface layer 2*c* is made further smaller (thinner) than 1/100 (15 μm) of the thickness of the electroconductive elastic layer 2*b* so that a surface hardness of the charging roller satisfy a condition described later.

Incidentally, in this embodiment, the electroconductive elastic layer 2*b* is formed of the same material in a single layer, but may also be formed in a plurality of layers.

(Surface Hardness of Charging Roller)

When the surface hardness of the charging roller 2 is low, by the contact with the photosensitive drum 1, there was an inconvenience such as "set" which a phenomenon that a recessed trace remains on the charging roller 2. Further, when the hardness is excessively low, there is also a problem such that when the charging roller 2 is press-contacted to the photosensitive drum 1, the minute projections 201 are deformed (collapsed) and thus the gap satisfying the formula 2 is not formed between the charging roller 2 and the photosensitive drum 1. For this reason, in this embodiment, on the surface of the electroconductive elastic layer 2*c*, the surface layer 2*c* harder than the electroconductive elastic layer 2*b* is formed (coated). That is, in the case where the surface layer 2*c* is provided on the electroconductive elastic layer 2*b*, compared with the case where the surface layer 2*c* is not provided, an Asker C hardness of the surface of the charging roller becomes large.

As a result, it is possible to suppress the deformation (collapse) of the minute projections 201 and formation of the recessed trace on the charging roller 2. However, the hardness of the charging roller 2 is excessively high, an abrasion amount (wearing amount) of the photosensitive drum 1 becomes large by abrasion (wearing) between the charging roller 2 and the photosensitive drum 1. For this reason, the surface hardness of the charging roller 2 is required to be a value in a certain range.

In view of this, the Asker C hardness of the surface of the charging roller 2 was suitable when it was 60 degrees or more and 90 degrees or less, preferably 80 degrees or more and 90 degrees or less. In this embodiment, the charging roller 2 having the hardness of the 85 degrees in terms of the Asker C hardness.

Incidentally, the Asker C hardness was measured under a constant load, for the Asker C measurement, of 9.8 N (1 kgf) at 120-degree pitch positions with respect to a circumferential direction at each of a central portion and left and right portions each spaced from the central portion by 90 mm (i.e., at 9 positions in total) at the surface of the charging roller 2. Further, not only the Asker C hardness but also an MD-1 hardness was measured. It was suitable that the MD-1 hardness was 50 degrees or more and 85 degrees or less, preferably from 60 degrees to 70 degrees. Incidentally, the MD-1 hardness was such that the hardness was measured in a minute range as a measurement range. The Asker C hardness shows the hardness was measured in the measurement range broader than the measurement range of the MD-1 hardness.

In this embodiment, the charging roller having the hardness of 64 degrees in terms of the MD-1 hardness.

Incidentally, the measurement of the MD-1 hardness was carried out in the following manner. That is, after the charging roller 2 is left standing for 4 hours or more in an environment of 23° C./60% RH, the hardness was measured by a MD-1 micro-rubber hardness meter at 180-degree pitch positions with respect to the circumferential develop at the central portion and left and right portions each spaced from the central portion by 90 mm at the surface of the charging roller (i.e., at 6 positions in total). An average of the measured values is the MD-1 hardness.

Further, the resistance value of the charging roller 2 was $0.3\times10^{6}$ ω·cm at 23° C. and 60% RH.

Incidentally, the resistance value of the charging roller 2 was calculated in the following manner. That is, the charging roller 2 was, after being left standing for 24 hours or more in the environment of 23° C. and 60% RH, pressed against a mirror-surfaced metal roller, having a diameter of 30 mm, of a current measuring device under a total load of 9.8 N in the environment, and then a voltage was applied while rotating the mirror-surfaced metal roller at a speed of 30 rpm (while the charging roller 2 is rotated by the metal roller). Then, in this state, the resistance value was calculated from a DC current at the time of third rotation of the charging roller 2.

(Gap Measuring Method at Contact Nip)

A gap measuring method in a contact state of the charging roller 2 in the contact nip which is the feature of this embodiment will be described. In order to generate the electric discharge at the contact nip between the photosensitive drum 1 and the charging roller 2, the electrically dischargeable distance is maintained at the contact nip.

Figure 6:
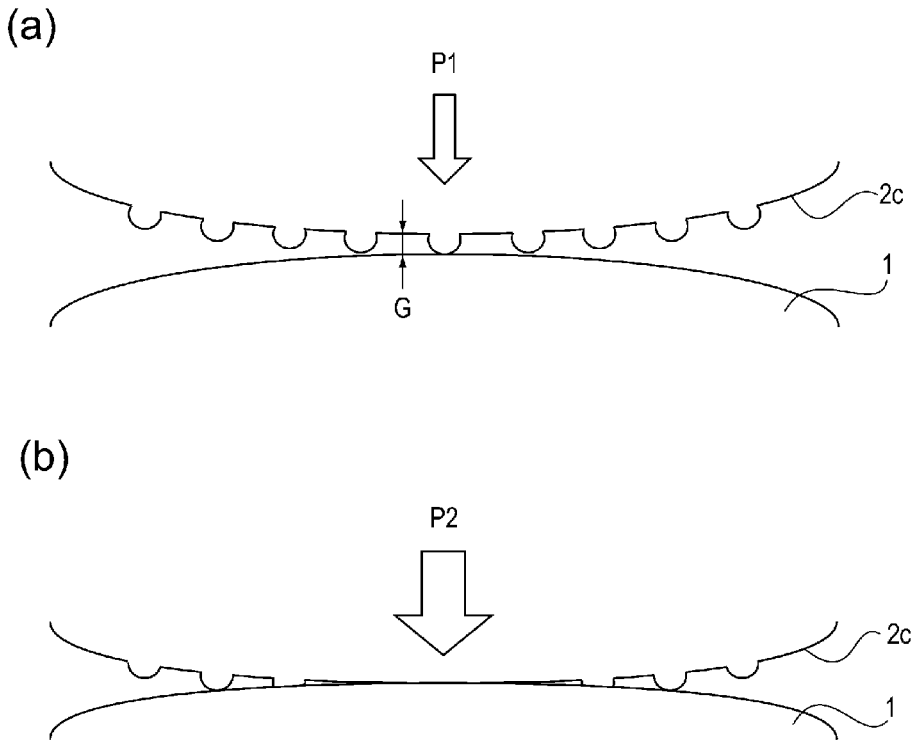
In FIG. 6, (a) and (b) are enlarged schematic views showing a contact nip between the charging roller and the photosensitive drum.

In FIG. 6, (a) and (b) are enlarged schematic views of the contact nip between the charging roller 2 and the photosensitive drum 1, in which an upper side in each of the figures represents the charging roller surface, and a lower side in each of the figures represents the photosensitive drum surface. In FIG. 6, (a) shows the contact state in the case where a contact pressure P1 is proper, and (b) shows the contact state in the case where a contact pressure P2 is strong. A relationship between values of these contact pressures is P1<P2.

In FIG. 6, with respect to elasticity of the charging roller 2, when the contact pressure is strong, a surface shape cannot maintain a minute B air gap G at the contact nip. In this embodiment, the charging roller 2 is contacted to the surface of the photosensitive drum 1 by being pressed at each of the end portions under a load of 500 gram-weight (at each end portion) by the spring as described above.

The air gap G was measured, after a measuring object was left standing for 2 hours or more at 23° C. and 60% RH, by using a gap measuring machine ("GM1000L", manufactured by Optron Co., Ltd.).

Figure 7:
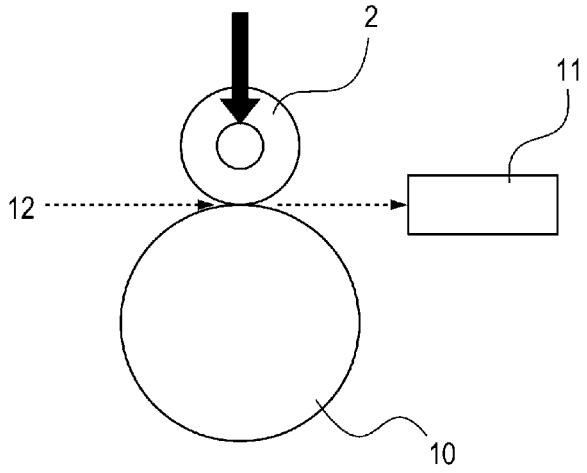
FIG. 7 is a schematic view showing a state in which an air gap is measured.

FIG. 7 is a schematic view showing a state in which the air gap G is measured.

As shown in FIG. 7, the charging roller 2 was contacted to a matte reference metal roller 10 having a diameter of 50 mm under a load of 9.8 N (1 kg-weight), and then was subjected to laser scanning 12 from a back surface thereof in a state in which the reference metal roller 10 was rotated at 0.32 rps. Then, a gap generated between the charging roller 2 and the reference metal roller 10 was measured for 3 sec by a detector 11. The charging roller 2 used in this embodiment provided the minute air gap G, at the contact nip N between the charging roller 2 and the photosensitive drum 1, of 10 μm at the central portion thereof. Therefore, the dischargeable distance d satisfies $d>7.7\times10^{-6}$ m, and thus the charging roller 2 in this embodiment satisfies the electric discharge condition at the contact nip N.

(Comparison Verification)

In order to check an effect of the present invention, charging rollers 2 in Comparison Examples in which different condition were employed were prepared.

Figure 8:
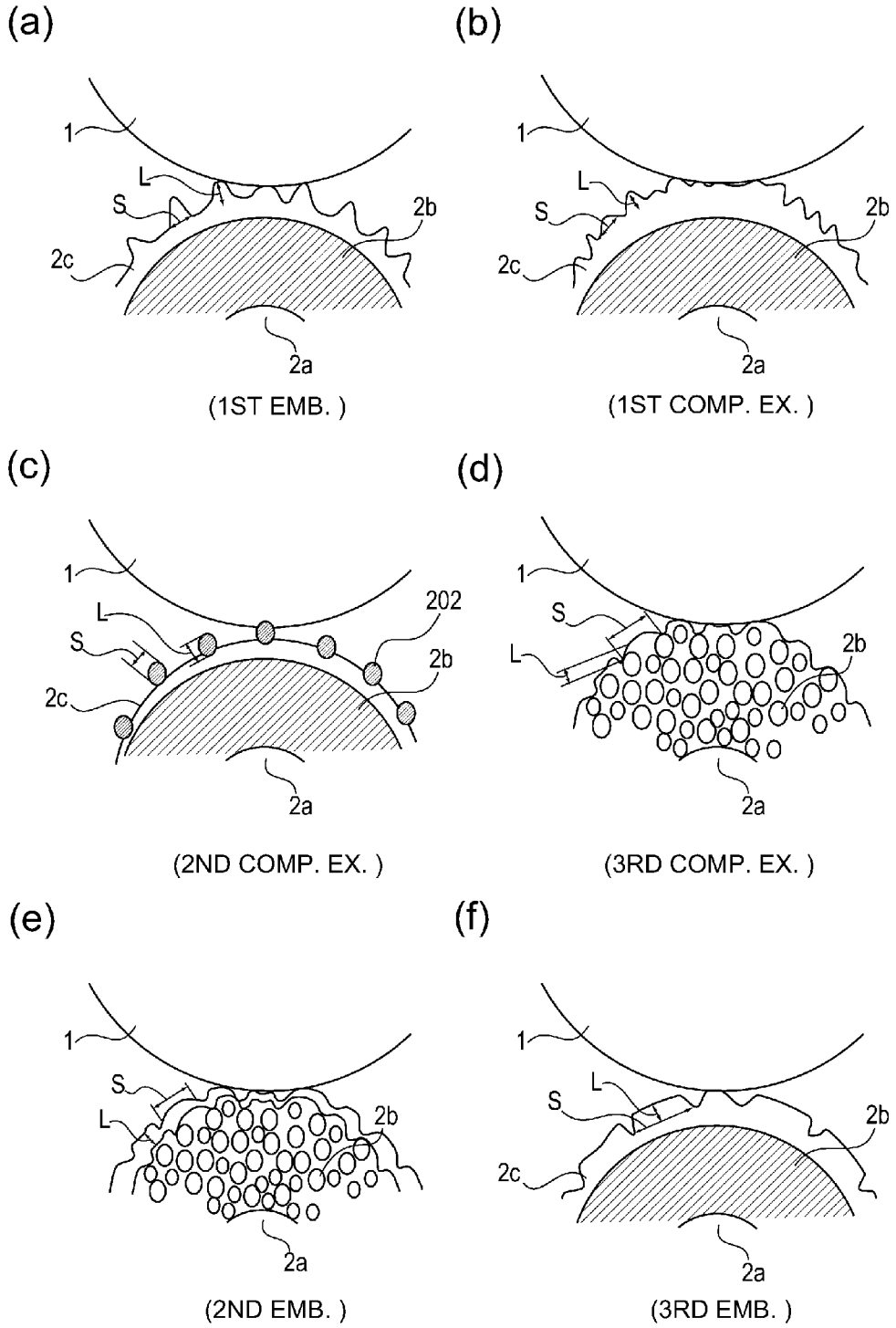
In FIG. 8, (a) to (f) are schematic sectional views each showing the charging roller and the photosensitive drum during contact therebetween in a First Embodiment, a First Comparison Example, a Second Comparison Example, a Third Comparison Example, a Second Embodiment or a Third Embodiment, respectively.

In FIG. 8, (a) to (f) are schematic sectional views each showing the charging roller and the photosensitive drum during contact therebetween in the First Embodiment, a First Comparison Example, a Second Comparison Example, a Third Comparison Example, and a Second Embodiment or Third Embodiment, respectively. FIG. 9 is a table showing physical properties of charging rollers in First to Third Comparison Examples and First to Third Embodiments.

Further, verification was made by conducting comparison evaluation from the viewpoints of a gap distance of the contact nip N between the photosensitive drum 1 and the charging roller 2, damage of the photosensitive drum 1 and set (change in shape of the charging roller 2 by the contact with the photosensitive drum 1) of the charging roller 2.

FIG. 10 is a table showing a comparison result of the charging rollers 2 in the First to Third Comparison Examples and the First to Third Embodiments.

First, with respect to the gap distance of the contact nip B between the photosensitive drum 1 and the charging roller 2, the case where the gap distance d(=L(1−p/ES) during the contact between the photosensitive drum 1 and the charging roller 2 satisfied $d>7.7\times10^{-6}$ m was evaluated as "o", and the case where the gap distance d did not satisfy $d>7.7\times10^{-6}$ m was evaluated as "x". Further, with respect to the damage of the photosensitive drum 1 and the set of the charging roller 2, the case where the image outputted by the image forming apparatus in this embodiment was at a level of practically no problem was evaluated as "o", and the case where the output image was not at the level was evaluated as "x".

Comparison Examples

Next, the respective charging rollers used for comparison will be described. The charging roller in the First Comparison Example is, compared with the charging roller in the First Embodiment, low in hardness and surface roughness. The charging roller in the Second Comparison Example is prepared by providing the charging roller in the First Comparison Example with a 20 μm-thick non-elastic spacer 202 of an insulating material on an outermost surface thereof.

(Verification 1: Gap Distance)

The charging rollers in the First and Second Comparison Examples satisfy: $L(1-P/EP)>7.7\times10^{-6}$ m (formula 1) and thus are capable of generating the electric discharge at the contact nip N. In the First Comparison Example, the surface layer of the charging roller is hard, and the dischargeable gap cannot be maintained at the contact nip N where the surface roughness is low.

(Verification 2: Recording Material Damage)

By using the charging rollers in the respective Comparison Examples, in the image forming apparatus in this embodiment in an environment of 32.5° C. and 80% RH, the charging roller and the photosensitive drum 1 were contacted to each other, and then two-sheet intermittent printing was carried out at a print ratio of 2%. Then, a state of an occurrence of image defect (inconvenience) at the time of 15,000 sheets was compared. The charging roller generating the image defect due to the damage of the photosensitive drum 1 is the charging roller in the Second Comparison Example. This was because the non-elastic spacer at the surface layer and the photosensitive drum 1 rubbed with each other and therefore the image defect due to the damage of the photosensitive drum 1 was generated. In the First Embodiment and the First Comparison Example, the surface layer is the elastic member, and therefore the image defect due to the damage of the photosensitive drum 1 is not generated.

(Verification 3: Charging Roller Set)

Verification was made by outputting the image by the image forming apparatus in this embodiment in an environment of 23° C. and 50% RH after the charging roller and the photosensitive drum which were placed in the contact state under a condition of the process cartridge in this embodiment were left standing for 30 days in an environment of 40° C. and 95% RH.

In the First Embodiment and the First and Second Comparison Examples, no set was generated.

By satisfying $L(1-P/ES)>7.7\times10^{-6}$ m while the charging roller 2 has the elasticity at the surface layer, the electrically discharging region ("REGION") is increased with a simple constitution, whereby it was possible to realize the charging device reducing the damage on the photosensitive member by the contact charging member while obtaining a high charging property.

As described above, by satisfying $L(1-P/ES)>7.7\times10^{-6}$ m while the charging roller 2 has the elasticity at the surface layer, the discharging region is increased with the simple constitution, whereby the high charging property was obtained. Further, by using the elastic charging member, it is possible to provide the charging device reducing the damage of the photosensitive drum 1 while suppressing the influence of deformation of the contact charging member. That is, it is possible to suppress the damage of the photosensitive drum 1 and the set at the charging roller while enabling the generation of the electric discharge at the contact nip N.

Further, the minute projections 201 (projected portions) provided at the surface layer 2*c* are formed by the particles contained in the surface layer 2*c*, and therefore even when the charging roller 2 is used for a long term, a size of the minute projections 201 is not readily changed (i.e., the minute projections 201 are not readily deformed or collapsed). Accordingly, the dischargeable gap can be stably maintained.

Incidentally, in this embodiment, the process cartridge as the unit of the photosensitive drum 1, the charging roller 2, the developing device 5 and the cleaning device 9 is formed, and is detachably mountable to a main assembly of the image forming apparatus. When at least the charging device of the present invention is incorporated in the process cartridge, a similar effect can be obtained also in the process cartridge.

Further, in this embodiment, the shape of the charging member is the roller shape, but is not limited thereto. Also with respect to the shape of the charging member, when the charging member has the surface shape described in this embodiment, a similar effect can be obtained by applying the present invention to the charging member.

Further, in this embodiment, the sine wave is applied as the waveform of the AC component of the oscillating voltage, but is not limited thereto. Further, in this embodiment, the voltage applied to the charging roller 2 includes the AC component, but only the DC component may also be applied to the charging roller 2. That is a DC charging method (type) may also be employed.

Incidentally, in this embodiment, as the toner, the magnetic toner is used, but is not limited thereto. For example, a similar effect can be obtained even when a non-magnetic toner is used. Further, in this embodiment, the jumping developing method is employed, but is not limited thereto. For example a similar effect can be obtained even when a contact developing method is employed.

(Effect of this Embodiment)

Effects of this embodiment are summarized as follows. In this embodiment, the electric discharge gap is ensured also at the nip by providing the charging roller 2 with the minute projected portions, whereby the electric discharge is enabled also at the nip. As a result, the discharging region is broadened and thus it is possible to obtain the high charging property, so that the image forming apparatus is capable of meeting high-speed image formation without increasing electric power consumption.

Further, particularly in the case where the charging roller 2 in this embodiment is used in the image forming apparatus in which the AC charging type is employed, there is an effect of suppressing generation of the image defect which is called a moire pattern. In the following, description thereof will be made.

In the case of employing the AC charging type, the voltage (charging bias) applied to the charging roller is the AC voltage, and therefore there was the case where the surface potential of the photosensitive drum after the charging caused the same periodic fluctuation as the AC voltage.

In the case where an image (e.g., an image such that a plurality of rectilinear lines each extending in a longitudinal direction of the photosensitive member are arranged at uniform intervals) having a periodic pattern is intended to be formed, there was the case where the moire pattern was generated on the formed image. This is because a difference between a potential fluctuation period (AC voltage period) of the photosensitive drum and an image pattern period causes interference, and thus a striped pattern (interference fringe, moire) is caused on the image. Accordingly, in the case where the AC charging type was employed in the conventional image forming apparatus, there was a need to take countermeasures such that an AC voltage period was selected so as not to generate the moire pattern.

However, in the case where the charging roller 2 in this embodiment is used, the discharging region is large, and therefore even when the AC voltage is applied to the charging roller 2, the surface potential of the photosensitive drum 1 does not readily cause the periodic fluctuation. As a result, even when the image having the periodic pattern is formed, the moire is not readily generated on the image.

<Second Embodiment>

In this embodiment, a charging device using a charging roller 2, as the charging member including the base layer (electroconductive elastic layer 2*b*) formed with a foam member and the surface layer 2*c* coated with an electroconductive elastic conductor, different from the charging roller 2 in the First Embodiment is used. The surface layer is formed of a material harder than a material for the base layer. The foam member constituting the base layer is an electroconductive foam member having an average cell diameter of 100 μm.

The material for the foam member is such that polyurethane elastomer is prepared by co-polymerizing polyethylene oxide in polyol and then by adding therein $LiClO_4$ so as to adjust a value resistivity at $10^{11}$ Ωcm, and then $Sn_2.Sb_2O_5$ having a specific resistance of $10^7$ Ωm is added as an electroconductive elastic filler into the polyurethane elastomer in an amount of 100 phr so as to the volume resistivity of $10^6$ Ωm, and thereafter a resultant polymer is foamed to provide the foam member.

Then, the gap to be formed between the charging roller 2 and the photosensitive drum 1 by the minute projections 201 is formed by the contact of the projected portions of the projected and recessed portions, formed at the surface of the foam member, with the photosensitive drum 1 via the surface layer 2*c*. That is, the surface shape of the electroconductive elastic layer 2*b* (foam member).

In order to check the effect of the present invention, the charging rollers in Comparison Examples different in condition were prepared. The schematic sectional views each showing the charging roller and the photosensitive drum during the contact therebetween in the respective Comparison Examples and the respective Embodiments are as shown in (a) to (g) of FIG. 8, and the physical properties of the charging rollers 2 in the respective Comparison Examples and the respective Embodiments are as shown in FIG. 9. Further, the comparison result of the charging rollers 2 in the respective Comparison Examples and the respective Embodiments are as shown in FIG. 10.

In the Third Embodiment, in the charging device in the Second Comparison Example, the surface layer of the charging roller is formed with an electroconductive foam having an average cell diameter of 100 μm. For that reason, the surface roughness cannot be measured, and therefore the box for the surface roughness Rz in FIG. 9 is a blank.

Next, comparison verification will be made. The verification was conducted with respect to the gap distance, the photosensitive member damage and the charging roller set similarly as in the First Embodiment.

(Verification 1: Gap Distance)

In the Second Embodiment and the Third Comparison Example, $L(1-P/ES)>7.7\times10^{-6}$ m (formula 1) is satisfied, so that the electric discharge is enabled at the contact nip.

(Verification 2: Photosensitive Drum Damage)

In both the Second Embodiment and the Third Comparison Example, the surface is formed with the elastic member, and therefore the image defect due to the damage of the photosensitive drum 1 was not observed.

(Verification 3: Charging Roller Set)

In Third Comparison Example, the charging roller 2 caused periodic stripes. This was because the foam member was changed in shape to cause improper charging, which lead to the image defect. In the Second Embodiment, the surface layer of the foam member is coated with the elastic member, and therefore a degree of a shape deformation of the charging roller by the contact with the photosensitive drum is small, so that the image defect is not readily caused to occur.

Therefore, by satisfying $L(1-P/ES)>7.7\times10^{-6}$ m while the charging roller 2 has the elasticity at the surface layer thereof, the discharging region is increased with a simple constitution, whereby it is possible to reduce the damage on the photosensitive drum 1 by the contact charging member while obtaining the high charging property.

<Third Embodiment>

In this embodiment, a charging device using a charging roller, as the charging member, including the surface layer which is partly removed by etching or the like so that a minute shape is a recessed shape relative to a projected shape of the surface layer in the First Embodiment is used. The etching was performed in such a manner that a resist was applied onto the surface layer, and was peeled off after being irradiated with electron beam (EB), and then the resultant surface layer was subjected to dry etching.

That is, when the surface layer 2*c* is provided with a plurality of recessed portions by the etching, the surface layer 2*c* is provided with the projected and recessed portions. A region sandwiched between adjacent two recessed portions corresponds to the projected portion.

For the comparison verification the charging rollers in the Comparison Examples different in condition were prepared. The schematic sectional views each showing the charging roller 2 and the photosensitive drum 1 during the contact therebetween in the respective Comparison Examples and the respective Embodiments are as shown in (a) to (g) of FIG. 8. Further, the physical properties of the charging rollers 2 in the respective Comparison Examples and the respective Embodiments are as shown in FIG. 9. Further, the comparison result of the charging rollers 2 in the respective Comparison Examples and therespective Embodiments are as shown in FIG. 10.

Next, the comparison verification was made. The verification was conducted with respect to the gap distance, the photosensitive member damage and the charging roller set similarly as in the First Embodiment.

(Verification 1: Gap Distance)

In Third Embodiment, $L(1-P/ES)>7.7\times10^{-6}$ m is satisfied, so that the electric discharge is enabled at the contact nip.

(Verification 2: Photosensitive Member Damage)

In Third Embodiment, the surface is formed with the elastic member, and therefore the image defect due to the damage of the photosensitive drum 1 was not observed.

(Verification 3: Charging Roller Set)

In the Third Embodiment, the set was not observed.

Therefore, even when the minute shape of the surface layer is the recessed shape (recessed portion), the charging roller 2 satisfied $L(1-P/ES)>7.7\times10^{-6}$ m while having the elasticity at the surface layer thereof. As a result, by satisfying $L(1-P/ES)>7.7\times10^{-6}$ m while the charging roller 2 has the elasticity at the surface layer thereof, the discharging region is increased with a simple constitution, whereby the high charging property was obtained. Further, by using the elastic charging member, the influence by the deformation of the contact charging member is suppressed, and thus it is possible to provide a charging device reducing a degree of the damage of the photosensitive member.

<Fourth Embodiment>

A Fourth Embodiment will be described. Incidentally, constitutions common to the First and Fourth Embodiments are omitted from description in some cases.

In the above-described embodiments, the charging rollers 2 are provided with the projected and recessed portions at the surfaces thereof, and therefore the gap is created even within the contact nip with the photosensitive member, so that the electric discharge is generated. For this reason, the number of occurrences of the electric discharge of the photosensitive member per unit area is increased, so that there is a possibility that abrasion of the surface of the photosensitive member is accelerated.

Here, there is a tendency that the photosensitive drum layer is liable to be abraded at longitudinal end portions of the photosensitive drum more than at a longitudinal central portion of the photosensitive drum. Accordingly, this embodiment is characterized in that the degree of the electric discharge is reduced at the longitudinal end portions of the photosensitive drum than at the longitudinal central portion of the photosensitive drum.

Incidentally, the factor that the drum surface is liable to be abraded at the photosensitive member end portions than at the photosensitive member central portion is principally attributable to the following reasons.

The photosensitive drum is supported by bearings provided at end portions thereof, while almost all region thereof contacts the cleaning blade and thus is pressed by the cleaning blade.

For this reason, compared with the end portions where the photosensitive drum is supported by the bearings, the photosensitive drum is warped at the central portion by a force received from the cleaning blade. As a result, a contact pressure between the cleaning blade and the photosensitive member is higher at the longitudinal end portions than at the longitudinal central portion. Accordingly, at the end portions of the photosensitive drum, a frictional force of the cleaning blade is larger than that at the central portion of the photosensitive drum, and therefore the surface layer of the photosensitive drum is liable to be abraded.

Further, the photosensitive drum surface layer is abraded by friction when the recording material passes through a transfer nip between the photosensitive drum and the transfer roller. Further, pressure (transfer pressure) at the transfer nip between the photosensitive drum and the transfer roller in the state in which the recording material is interposed between the photosensitive drum and the transfer roller is higher at the recording material end portions than at the longitudinal central portion. Accordingly, portions of the photosensitive drum surface layer corresponding to the recording material end portions are liable to be abraded.

Therefore, in this embodiment, a contact charging member reducing a degree of the abrasion of the photosensitive member at the end portions thereof is intended to be provided.

(Charging Roller)

Figure 11:
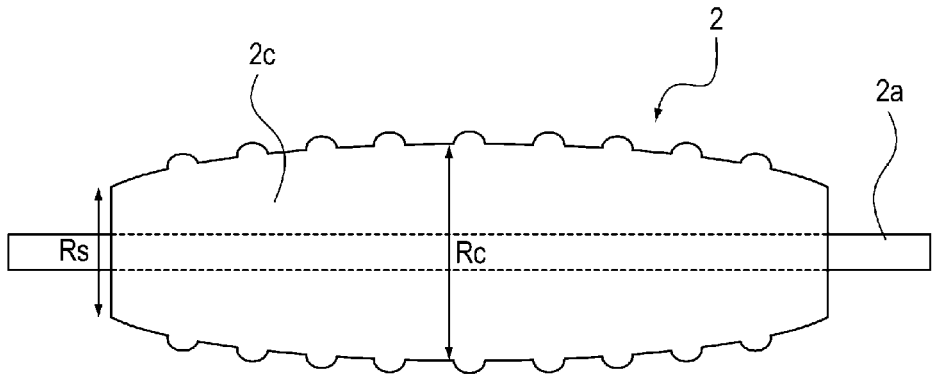
In FIG. 11, (a) and (b) are schematic views showing a structure of the charging roller, in which (a) is the schematic view showing a shape of the charging roller, and (b) is a cross-sectional view of the charging roller.
Figure 11:
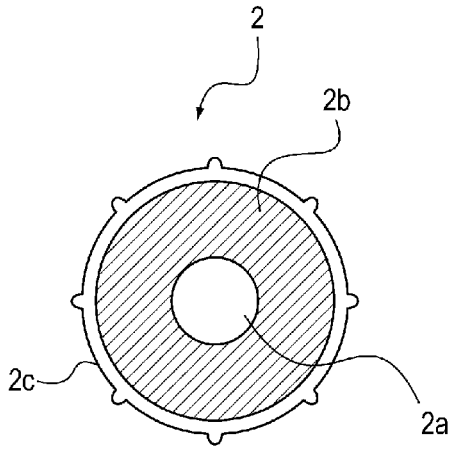

In FIG. 11, (a) and (b) are schematic views showing a structure of the charging roller 2 in this embodiment, in which (a) is the schematic view showing a shape of the charging roller 2, and (b) is a cross-sectional view of the charging roller 2.

As shown in these figures, the charging roller 2 in this embodiment includes an electroconductive support 2*a*, an electroconductive elastic layer 2*b* (elastic layer) formed at an outer peripheral surface of the electroconductive support 2*a*, and a surface layer 2 (elastic surface layer) coating an outer peripheral surface of the electroconductive elastic layer 2*b*.

The electroconductive elastic layer 2*b* was formed by mixing an electroconductive agent (e.g., an ion conductive agent such as quaternary ammonium salt or an electron conductive agent such as carbon black) with a polymeric elastic member (e.g., epichlorohydrin rubber or acrylonitrile rubber). Further, the electroconductive elastic layer 2*b* was formed in a roller shape concentrically integral with the electroconductive support 2*a*.

Thereafter, the thickness of the electroconductive elastic layer 2*b* is adjusted by abrasion, so that the charging roller 2 is formed in a crown shape as shown in (a) of FIG. 11 in which an outer diameter Rc at the longitudinal central portion thereof is 10.15 mm and an outer diameter Rs at the longitudinal end portions thereof is 10.06 mm. In this embodiment, by making the central portion outer diameter larger than the end portion outer diameters, a penetration amount of the charging roller 2 into the photosensitive drum 1 at the central portion is made larger than the penetration amount at the end portions.

Here, the penetration amount refers to a value representing an entering amount which is a depth through which an outer diameter portion of the charging roller 2 enters a phantom outer diameter portion of the photosensitive drum 1, and is obtained as a value obtained by subtracting a center (-to-center) distance between the photosensitive drum 1 and the charging roller 2 from the sum of a radius of the photosensitive drum 1 and a radius of the charging roller 2.

After the electroconductive elastic layer 2*b* is prepared, as a coating layer, the surface layer 2*c* thinner than the electroconductive elastic layer 2*b* was provided. In this embodiment, the surface layer 2*c* was formed by subjecting the surface of the electroconductive elastic layer 2*b* to curing by heat, light irradiation with ultraviolet light (beam) or the like, or electron beam irradiation. That is, the surface 2*c* is harder than the electroconductive elastic layer 2*b*. The surface layer 2*c* in this embodiment contains at least a surface layer binder and fine particles (having a volume-average particle size of 10-50 μm, preferably 20-40 μm) as a surface-roughening agent, and the fine particles may be any of spherical particles or irregular-shaped particles. Further, an amount of the fine particles contained in the surface layer binder is 10-100 wt. %. Incidentally, in this embodiment, the fine particles of 26 μm in particle size was used to prepare the surface layer 2*c* so that the amount of the fine particles contained in the surface layer binder was 50 wt. %.

A ten point average roughness Rzjis (according to JIS 1994) of the surface of the charging roller 2 prepared in the above-described manner is Rzjis=15-50 μm, preferably Rz=20-30 μm. When Rzjis is excessively small the electric discharge nip has a rectilinear shape (i.e., the width of the electric discharge nip region where the electric discharge is generated is narrowed), a period of the photosensitive drum 1 after the charging is periodically changed depending on the frequency of the AC component (i.e., non-uniformity of charge potential change generated at the surface of the charging roller 2 has the rectilinear shape). For this reason, it becomes difficult to suppress the generation of the moire pattern. On the other hand, when Rzjis is excessively large, the toner (toner particles and an external additive) is deposited on the charging roller 2 by long-term use and thus the charging roller 2 is liable to be contaminated or liable to cause non-uniformity of contamination, so that it becomes difficult to maintain initial charge uniformity for a long term.

In this embodiment, the surface roughness Rzjis of the charging roller 2 is Rzjis=26 μm. The surface roughness Rzjis was measured by using a surface roughness meter ("SE3500", manufactured by Kosaka Laboratory Ltd.) under a condition of 8.0 mm in measurement length, 0.8 mm in cut-off value, and 0.3 mm/sec in measurement speed.

Further, in this embodiment, the Young's modulus E of the layer as the sum of the electroconductive elastic layer 2*b* and the surface layer 2*c* of the charging roller 2 may preferably be 10-150 MPa. Incidentally, the Young's modulus E of the charging roller 2 was calculated from a distortion amount after a load, of 100 $mN/mm^2$ applied in 1 minute by a universal hardness meter (a surface film physical property testing machine "Fishcerscope H100C", manufactured by Fischer Instruments K.K.), reaches 100 $mN/mm^2$. The Young's modulus E of the charging roller used in this embodiment was 20 MPa.

Further, the surface hardness of the charging roller 2 may preferably be 60 degrees or more and 90 degrees or less, more preferably from 80 degrees to 90 degrees in terms of the Asker C hardness. When the hardness is excessively low, the minute gap is not formed in the region of the contact nip with the photosensitive drum 1, so that a foreign matter such as the toner deposited on the photosensitive drum 1 is liable to be deposited on the charging roller 2. Therefore, in this embodiment, the hard surface layer 2*c* is provided on the surface of the electroconductive elastic layer 2*b*. As a result, the Asker C hardness of the surface of the charging roller 2 is made higher than that in the case where there is no surface layer 2*c*. On the other hand, when the hardness is excessively hard, not only the nip cannot be ensured between the charging roller 2 and the photosensitive drum 1 but also there is the case where, e.g., the surface of the photosensitive drum 1 is gradually abraded by the long-term use. Therefore, the thickness of the surface layer 2*c* is caused to fall within a predetermined range (i.e., is controlled so as not to be excessively thick), so that the surface hardness ofthe charging roller 2 is controlled so as not to be excessively high. In this embodiment, the charging roller 2 having the Asker C hardness of 85 degrees was used. Incidentally, the Asker C hardness was measured under a condition of a load of 1000 g by bringing an urging needle of an Asker C hardness meter (manufactured by Tokyo Keiki Inc.) into contact with the surface of the charging roller 2.

Further, the resistance value of the charging roller 2 was $0.3\times10^6$ ω·cm at 23° C. and 60% RH. Incidentally, for measurement of the resistance value of the charging roller 2, first, the charging roller 2 was left standing for 24 hours or more in the environment of 23° C. and 60% RH. Thereafter, the charging roller 2 was pressed against a mirror-surfaced metal roller, having a diameter of 30 mm, of a current measuring device under a total load of 9.8 N in the environment, and then a voltage was applied while rotating the mirror-surfaced metal roller at a speed of 30 rpm so as to rotate the charging roller 2. Then, in this state, the resistance value was calculated from a DC current at the time of third rotation of the charging roller 2.

Further, the longitudinal length of the charging roller 2 was 230 mm.

(Positional Relationship Between Charging Roller and Photosensitive Drum)

FIG. 3 is the schematic front view of the charging roller 2 and the photosensitive drum 1.

As shown in FIG. 3, the charging roller 2 is rotatably held by the bearing member 32 at each of end portions of the electroconductive support 2*a*. Further, the charging roller 2 is urged toward the photosensitive drum 1 by the urging spring 31, thus being press-contacted to the surface of the photosensitive drum 1 at a predetermined urging force (500 gram-weight). The charging roller 2 is rotated by rotation of the photosensitive drum 1. Then, a predetermined charging bias is applied from a power source E to the charging roller 2 via the electroconductive support 2*a* as shown in FIG. 1, so that the peripheral surface of the photosensitive drum 1 is electrically charged to a predetermined potential. That is, in FIG. 3, a structure of a charging device for charging the photosensitive drum is shown.

(Structure of Air Gap Formed Between Charging Roller and Photosensitive Drum)

The air gap G which is a minute air layer formed between the charging roller 2 and the photosensitive drum 1 will be described.

Figure 12:
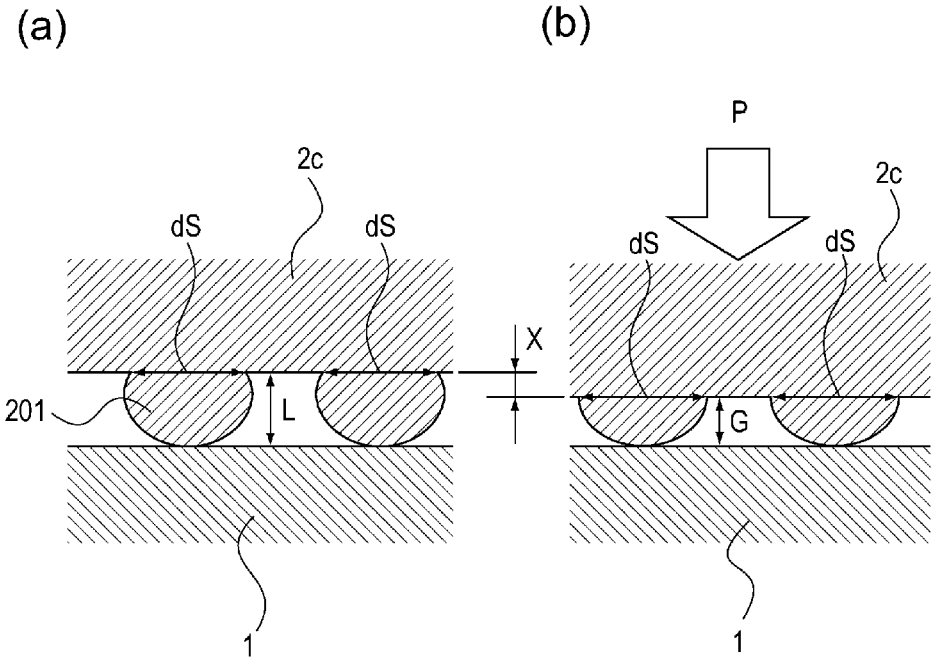
In FIG. 12, (a) and (b) are enlarged schematic views showing an air gap formed between the charging roller and the photosensitive drum, in which (a) shows a state in which there is no pressure of the charging roller, and (b) shows a state in which the charging roller is pressed against the photosensitive drum by a pressing force.

In FIG. 12, (a) and (b) are enlarged schematic views for illustrating the air gap G formed between the charging roller 2 and the photosensitive drum 1, in which an upper side shows the surface of the charging roller 2, and a lower side shows the surface of the photosensitive drum 1. In FIG. 12, (a) shows a state in which the charging roller 2 is contacted to the photosensitive drum 1 with no pressure, and (b) shows a state in which a gap between the photosensitive drum 1 and the charging member is compressed.

As shown in FIG. 12, a plurality of elastically deformable minute projected portions 201 formed by fine particles as a surface-roughening agent are provided at the outermost surface of the charging roller 2. When a height of the minute projected portions 201 is L and a deformation amount of the minute projected portions 201 with respect to the L direction is X, the air gap G is represented by the following formula 3.

$$G=L-X \quad \text{(formula 3)}$$

At this time, when the rubber is regarded as the spring and a distortion (strain) coefficient is Y, based on Hooke's law, the deformation amount X can be represented by the following formula 4.

$$X=YL \quad \text{(formula 4)}$$

This distortion coefficient Y can be represented, based on the Hooke's law when a synthetic Young's modulus of the charging roller 2 is E (MPa) and stress received by the minute projected portions 201 is Z (N/m), by the following formula 5.

$$Y=Z/E \quad \text{(formula 5)}$$

Further, the stress Z is obtained as a value obtained by dividing pressure P (N), for urging the charging roller 2 against the photosensitive drum 1, by ΣdS. That is, the following formula 6 holds.

$$Z=P/\Sigma dS \quad \text{(formula 6)}$$

Here, ΣdS is the sum of areas dS of the minute projected portions 201 contacting the photosensitive drum 1. That is, a contact area when a single minute projected portion 201 contacts the photosensitive drum 1 is dS. In the contact nip region, the plurality of minute projected portions 201 contact the photosensitive dru m 1, and therefore the sum of all these contact areas is ΣdS.

By using the above-described formulas 3 to 6, the value of the air gap G can be represented by the following formula 7.

$$G=L(1-P/ES) \quad \text{(formula 7)}$$

In the above, S ($m_2$) is ΣdS.

In the following, the air gap G described in this embodiment means the air gap G represented by the above formula 7.

(Surface Shape of Charging Roller)

The surface shape of the charging roller 2 in the region of the contact nip which is the feature of this embodiment will be described.

Figure 13:
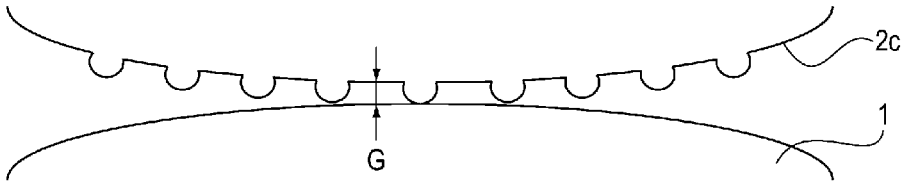
In FIG. 13, (a) and (b) are enlarged schematic views showing a contact nip region portion between the charging roller and the photosensitive drum, in which (a) shows a contact nip region at a longitudinal central portion, and (b) shows the contact nip region at a longitudinal end portion.
Figure 13:
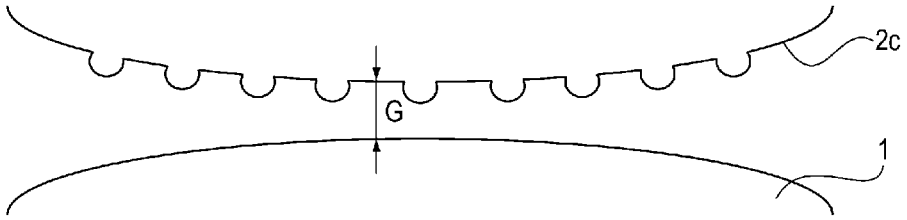

In FIG. 13, (a) and (b) are enlarged schematic views showing the contact nip region portion between the charging roller 2 and the photosensitive drum 1, in which (a) shows the contact nip region at a longitudinal central portion, and (b) shows the contact nip region at a longitudinal end portion. In FIG. 13, an upper side shows the charging roller surface, and a lower side shows the photosensitive drum surface. The charging roller 2 is, as described above, hermetically contacted to the photosensitive drum 1 by being pressed by the springs in each of the end portion sides under the load of 500 gram-weight.

Further, the charging roller 2 has the crown shape, and therefore the contact nip width is narrower at the end portions than at the central portion, and was 700 μm at the central portion and 400 μm at the end portions. Further, the air gap G in the region of the contact nip between the charging roller 2 and the photosensitive drum 1 was 10 μm at the central portion and 25 μm at the end portions. Incidentally, the contact nip width refers to a width (length along the rotational direction of the photosensitive drum 1) of a region where the charging roller 2 is press-contacted to the photosensitive drum 1.

The air gap G was measured, after a measuring object was left standing for 2 hours or more at 23° C. and 60% RH, by using the gap measuring machine ("GM1000L", manufactured by Optron Co., Ltd.).

FIG. 7 is the schematic view showing a state in which the air gap G is measured.

As shown in FIG. 7, the charging roller 2 was contacted to the matte reference metal roller 10 having a diameter of 50 mm under a load of 9.8 N (1 kg-weight), and then was subjected to laser scanning 12 from a back surface thereof in a state in which matte the reference metal roller 10 was rotated at 0.32 rps. Then, a gap generated between the charging roller 2 and the matte reference metal roller 10 was measured for 3 sec by the detector 11.

Here, the gap distance of dischargeable air gap G is calculated. A voltage applied between the charging roller 2 and an electroconductive base layer of the photosensitive drum 1 is allocated between an electrostatic capacity C1 of a photosensitive layer (an OPC photosensitive layer of 3 in dielectric constant and 18 μm in thickness) and an electrostatic capacity C2 of a minute air gap G portion formed between the charging roller 2 and the photosensitive layer.

Specifically, each of the electrostatic capacity C1 of the photosensitive layer and the electrostatic capacity C2 of the air layer is, when the distance d is a thickness of the air layer and a unit thereof is μm, represented by the following formula.

$$C1=3\times8.85\times10^{-12}\times1/18\times10^{-6}$$

$$C2=1\times8.85\times10^{-12}\times1/d\times10^{-6}$$

On the other hand, the dielectric breakdown voltage Vz of the minute air layer is represented by the following formula under the atmospheric pressure on the basis of the Paschen's law.

$$Vz=312+6.2d \text{ (where } 7.7\times10^{-6}m<d)$$

For this reason, there is need to satisfy:

$$((V-312)/6.2)\times10^{-6}m>d.$$

Further, under the atmospheric pressure, when the thickness of the air layer is 7.7 μm or less, the electric discharge is not generated based on the Paschen's law, and therefore when an applied voltage is V (V), a voltage Vair actually applied to the air layer is represented by:

$$V\text{air}=\{C1/(C1+C2)\}\times V.$$

In this case, the electric discharge is generated when Vair≥Vz.

Therefore, a voltage of 1000 V is applied, the gap distance d of the dischargeable air gap G is d=7.7 μm to 102 μm, and when a voltage of 2000 V is applied, the gap distance d of the dischargeable air gap G is d=7.7 μm to 265 μm.

In this embodiment, the AC component of the oscillating voltage to be applied to the charging roller 2 is the peak-to-peak voltage of 1600 V. For this reason, it would be understood that at each of the central portion where the air gap G is 10 μm in average and the end portions where the air gap G is 25 μm in average, based on the Paschen's law, the electric discharge is capable of being generated sufficiently between the surface of the charging roller 2 and the surface of the photosensitive drum 1.

That is, it is possible to form the electrically dischargeable gap over the entire region where the charging roller 2 is press-gap over the entire region where the charging roller 2 is press-contacted to the photosensitive drum 1.

Figure 14:
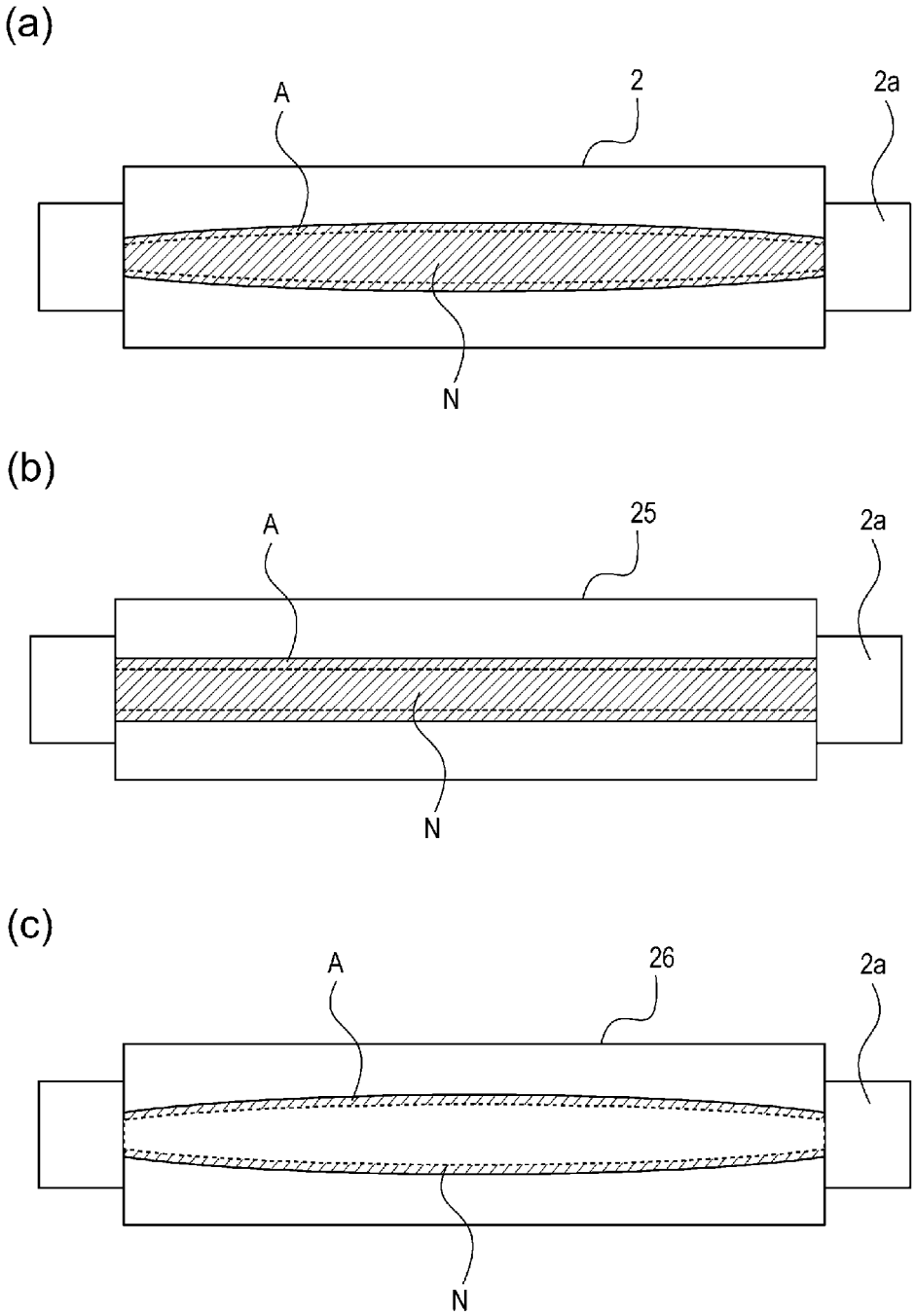
In FIG. 14, (a) to (c) are schematic views showing an electrically discharging region as seen in a direction of the charging roller from the photosensitive drum, in which (a) shows the case of the charging roller in the Fourth Embodiment, and (b) and (c) show the cases of the charging rollers in the Fourth and Fifth Comparison Examples, respectively.

In FIG. 14, (a) to (c) are schematic views showing an electrically discharging region as seen in a direction of the charging roller 2 from the photosensitive drum 1, in which (a) shows the case of the charging roller 2 in the Fourth Embodiment, and (b) and (c) show the cases of the charging rollers in the Fourth and Fifth Comparison Examples, respectively.

In (a) of FIG. 14, a hatched portion corresponds to a discharging region A, and a region defined by dotted lines corresponds to the contact nip N. That is, the discharging region A is constituted, at both the central portion and the end portions, by the entire surface in the region of the contact nip N between the charging roller 2 and the photosensitive drum 1 and by upstream and downstream sides of the region of the contact nip N. At the end portions, the discharging region A is narrower compared with that at the central portion since the width of the contact nip N between the charging roller 2 and the photosensitive drum 1 is narrow.

As described above, the charging roller 2 is formed in the crown shape to narrow the width of the contact nip N at the end portions, whereby the electric discharge in the region of the contact nip N was suppressed at the end portions. For this reason, it is possible to reduce a degree of photosensitive drum abrasion at the end portions.

Next, as the Fourth Comparison Example, a straight-shaped charging roller 25 with no crown portion was prepared.

In FIG. 14, (b) is the schematic view of the discharging region as seen in the charging roller direction from the photosensitive drum 1 in the case where the charging roller 25 in the Fourth Comparison Example is used. In the figure, a hatched portion corresponds to a discharging region A, and a region defined by dotted lines corresponds to the region of the contact nip N. That is, the discharging region A is constituted, at both the central portion and the end portions, similarly as in the Fourth Embodiment, by the entire surface in the region of the contact nip N between the charging roller 25 and the photosensitive drum 1 and by upstream and downstream sides of the region of the contact nip N.

However, the straight-shaped charging roller 25 provides a broad width of the region of the contact nip N at the end portions when compared with the crown-shaped charging roller 2 in the Fourth Embodiment (this embodiment), and therefore the discharging region at the end portions is broader than that of the charging roller 2 in this embodiment. The width of the region of the contact nip N of the straight-shaped charging roller 25 was 700 μm at both the central portion and the end portions.

A sheet-passing test was actually conducted by using the crown-shaped charging roller 2 in this embodiment and the straight-shaped charging roller 25 in the Fourth Comparison Example. An abrasion amount per 1000 pages (k pages) of the photosensitive drum 1 was 0.8 μm/k pages at the central portions in this embodiment and the Fourth Comparison Example. On the other hand, at the end portions, the abrasion amount of the straight-shaped charging roller 25 was 1.4 μm/k pages, and the abrasion amount of the crown-shaped charging roller 2 in this embodiment was 0.9 μm/k pages. Thus, the abrasion amount of the photosensitive drum 1 was able to be considerably reduced.

At the end portions of the photosensitive drum 1, a frictional force (contact pressure between the photosensitive drum and the cleaning blade 8) of the cleaning blade 8 is larger than that at the central portion, and therefore the abrasion amount of the photosensitive drum 1 is increased.

With respect to the charging roller 2 in this embodiment, as described above, by narrowing the width of the contact nip N at the end portions, the generation of the electric discharge in the region of the contact nip N at the end portions is suppressed, so that the abrasion amount of the photosensitive drum 1 at the end portions can be reduced.

Next, as the Fifth Comparison Example, a crown-shaped sponge charging roller 26 including a thick electroconductive elastic sponge layer was prepared.

In FIG. 14, (c) is the schematic view of the discharging region as seen in the charging roller 26 direction from the photosensitive drum 1 in the case where the charging roller 26 in Fifth Comparison Example is used. In the figure, a hatched portion corresponds to a discharging region A, and a region defined by dotted lines corresponds to the region of the contact nip N.

The charging roller 26 in the Fifth Comparison Example is 8 MPa in Young's modulus, and the Young's modulus thereof is lower than the Young's modulus of the charging roller 2 in the Fourth Embodiment (this embodiment). For this reason, the air gap G is not formed in the region of the contact nip N between the charging roller 26 and the photosensitive drum 1, so that the electric discharge is not generated in the region of the contact nip N. Accordingly, the discharging region A was constituted by only the upstream and downstream sides of the region of the contact nip N at both the central portion and the end portions.

A sheet-passing test was actually conducted by using the charging roller 2 in this embodiment and the charging roller 26 in Fifth Comparison Example. At the central portion, the abrasion amount per 1000 pages (k pages) of the photosensitive drum 1 was 0.6 μm/k pages for the charging roller 26 in the Fifth Comparison Example and was 0.8 μm/k pages for the charging roller 2 in this embodiment. On the other hand, at the end portions, the abrasion amount of the charging roller 26 was 1.2 μm/k pages, and the abrasion amount of the charging roller 2 in this embodiment was 0.9 μm/k pages. Thus, the abrasion amount of the photosensitive drum 1 was able to be considerably reduced.

The reason why the abrasion amount of the photosensitive drum 1 at the end portions is increased with respect to the charging roller 26 in the Fifth Comparison Example is that although the discharging region A is substantially the same between the central portion and the end portions, the frictional force of the cleaning blade is larger at the end portions of the photosensitive drum 1 than at the central portion of the photosensitive drum 1.

As described above, a constitution in which the air gap G formed between the charging roller 2 and the photosensitive drum 1 is disposed at random and in which the charging roller 2 is formed in the crown shape to narrow the width of the contact nip N at the end portions was employed in this embodiment. As a result, it is possible to reduce the abrasion amount of the photosensitive drum 1 at the end portions while suppressing the generation of the moire.

Further, with respect to a crown amount of the charging roller 2, in the case where a value thereof is excessively small, the shape of the charging roller 2 approaches the straight shape to broaden the width of the contact nip N at the end portions of the charging roller 2, and therefore the discharging region at the end portions is broadened. Further, on the other hand, in the case where the crown amount value is excessively large, at the longitudinal end portions, the charging roller 2 and the photosensitive drum 1 are excessively spaced from each other, and therefore improper charging occurs. Therefore, in this embodiment, the charging roller 2 was prepared so that the outer diameter Rs at the longitudinal end portions is smaller than the outer diameter Rc at the longitudinal central portion by a value in the range of 10 μm to 200 μm, preferably 30 μm to 100 μm.

Incidentally, in this embodiment, as the charging member, the recording material is used, but the present invention is not limited thereto. For example, the shape of the charging member may also be any shape such as a blade shape, a block shape or a pad shape. Also with respect to these shapes, if the shapes satisfy the surface shape described in this embodiment, a similar effect can be obtained by applying the present invention to the shapes.

Further, in this embodiment, the crown shape of the charging roller 2 is an arcuate shape, but is not limited thereto. For example, the shape of the charging roller 2 may also be a rectilinear shape.

Further, in this embodiment, as the waveform of the AC component of the oscillating voltage, the sine wave is applied, but the waveform is not limited thereto. For example, a voltage in the form of a rectangular wave, a saw-tooth wave, a triangular wave, or a rectangular wave formed by periodically turning on and off a DC voltage may also be applied.

Incidentally, in this embodiment, as the toner, the magnetic toner is used, but the toner is not limited thereto. For example, even when a non-magnetic toner is used, a similar effect can be obtained.

Further, in this embodiment, the jumping developing method is employed, but the developing method is not limited thereto. For example, even when a contact developing method is employed, a similar effect can be obtained.

(Fifth Embodiment)

This Embodiment is, different from the Fourth Embodiment in which the outer diameter of the charging roller is changed between the central portion and the end portions, characterized in that the charging roller outer diameter is changed between an image forming region and a non-image forming region. Incidentally, the image forming region refers to a region for forming the developer image (toner image) on the surface of the photosensitive drum 1. The non-image forming region refers to a region in which the developer image is not formed, and is positioned outside the image forming region with respect to the longitudinal direction of the photosensitive drum 1.

Figure 15:
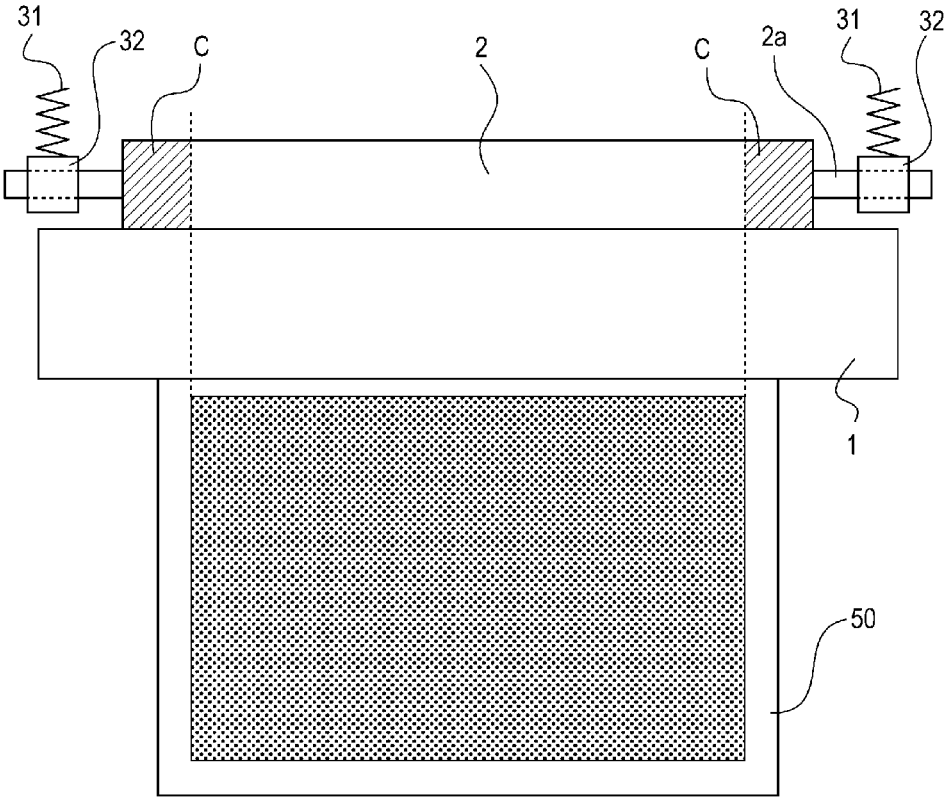
FIG. 15 is a schematic view showing a positional relationship among the charging roller, the photosensitive drum and a recording material.

FIG. 15 is a schematic view showing a positional relationship among the charging roller 2, the photosensitive drum 1 and the recording material 50 in this embodiment.

In this embodiment, an outer diameter Rc in the image forming region is 10.13 mm, and an outer diameter Rs in the non-image forming region is 10.02 mm.

In FIG. 15, with respect to the longitudinal direction of the charging roller 2, a portion inside dotted lines corresponds to the image forming region, and hatched portions each outside the dotted lines correspond to a non-image forming region C. In this embodiment, the non-image forming region C ranges by 12 mm from an end toward the central portion with respect to the longitudinal direction of the charging roller 2. Other constitutions are the same as those in the Fourth Embodiment.

When the air gap G exceeds 30 μm, the image defect due to the minute charging non-uniformity is generated, and therefore the air gap G in the image forming region was set at 30 μm or less. On the other hand, even when such improper charging is generated in the non-image forming region C, a large inconvenience is not generated, and therefore the air gap G in the non-image forming region C can be made 30 μm or more. However, when the air gap G is 50 μm or more, the surface of the photosensitive drum 1 cannot be electrically charged uniformly, so that the toner is used for development in the non-image forming region C to contaminate the transfer roller or the like. Therefore, the air gap G in the non-image forming region C was set at 50 μm or less.

In this embodiment, the air gap G in the region of the contact nip N was 30 μm or less in the image forming region, and was 30 μm or more and 50 μm or less in the non-image forming region C. Further, the width of the contact nip N in the non-image forming region C was 380 μm.

On the cleaning blade 8 contacting the photosensitive drum 1 in the image forming region, the toner in the form of fine particles functions as a lubricant. However, there is no toner on the photosensitive drum 1 in the non-image forming region C, and therefore in the non-image forming region C, a friction coefficient between the photosensitive drum 1 and the cleaning blade 8 becomes high. Accordingly, in the non-image forming region C, compared with the image forming region, a speed of abrasion of the photosensitive drum 1 is fast.

In this embodiment, by narrowing the width of the contact nip N in the non-image forming region C, the generation of the electric discharge in the region of the contact nip N was suppressed in the non-image forming region C.

Thus, in this embodiment, it becomes possible to reduce the photosensitive drum abrasion amount in the non-image forming region C, so that it is possible to realize lifetime extension of the photosensitive drum 1.

(Sixth Embodiment)

This Embodiment is different from the Fourth Embodiment in which the outer diameter of the charging roller is changed between the central portion and the end portions, characterized in that the charging roller outer diameter is changed between a sheet-passing portion and a boundary region between the sheet-passing portion and a non-sheet-passing portion. Incidentally, the sheet-passing portion refers to a region in which the recording material is to be fed and which is determined correspondingly to a width of the recording material. Further, the non-sheet-passing portion refers to a region in which the recording material is not fed, and is positioned outside the sheet-passing portion with respect to the longitudinal direction of the photosensitive drum 1.

In this embodiment, an outer diameter Rc at the sheet-passing portion (central portion of the photosensitive drum 1) is 10.12 mm, and an outer diameter Rs in the boundary region between the sheet-passing portion and the non-sheet-passing portion is 10.01 mm.

Figure 16:
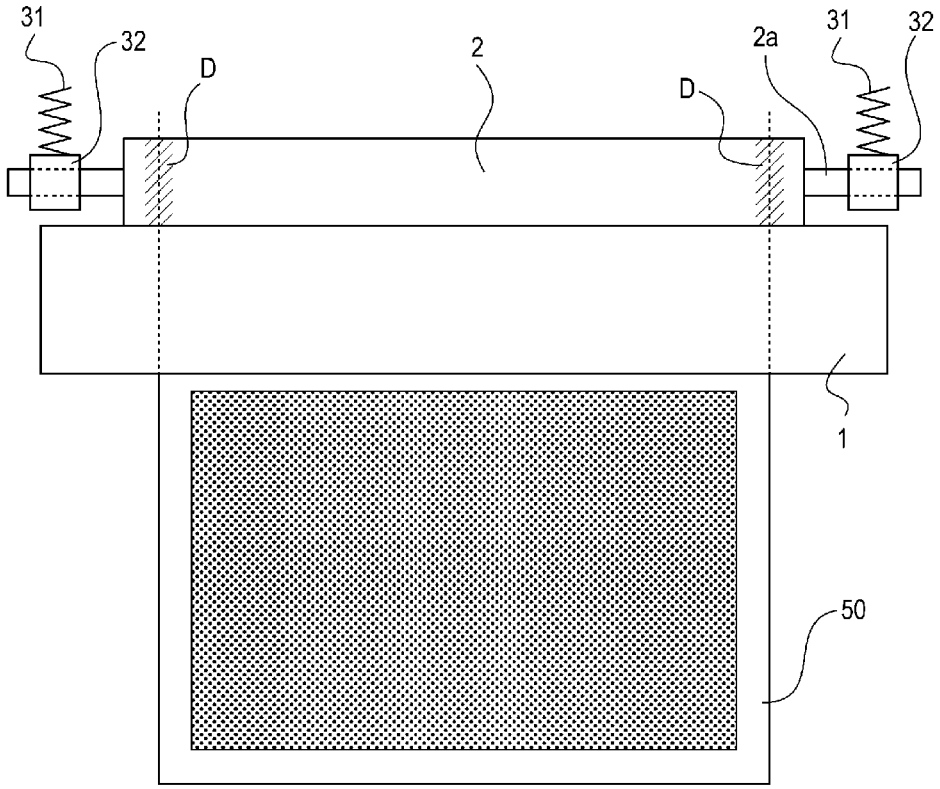
FIG. 16 is a schematic view showing longitudinal arrangement of the charging roller, the photosensitive drum and the recording material.

FIG. 16 is a schematic view showing a longitudinal arrangement of the charging roller 2, the photosensitive drum 1 and the recording material 50 in this embodiment.

mm.

As shown in the figure, with respect to the longitudinal direction of the charging roller 2, a portion inside dotted lines corresponds to the sheet-passing portion, portions each outside the dotted lines correspond to the non-sheet-passing portion, and each of hatched portions corresponds to the boundary region (boundary portion) D.

In this embodiment, the boundary region D between the sheet-passing portion and the non-sheet-passing portion ranges by 7 mm over the dotted line from the end portion toward the central portion with respect to the longitudinal direction of the charging roller 2. Other constitutions are the same as those in the Fourth Embodiment.

In this embodiment, similarly as in the Fifth Embodiment, there is a need to set the air gap G in the sheet-passing portion at 30 μm or less, and to set the air gap G in the boundary region D between the sheet-passing portion and the non-sheet-passing portion at 30 μ or more.

In this embodiment, the air gap G in the region of the contact nip N between the charging roller 2 and the photosensitive drum 1 was 30 μm or less in the sheet-passing portion, and was 30 μm or more and 50 μm or less in the boundary region D between the sheet-passing portion and the non-sheet-passing portion. Further, the width of the contact nip N in the boundary region D between the sheet-passing portion and the non-sheet-passing portion was 380 μm.

In recent years, the image forming apparatus such as a printer is, with diversification of print needs of users, required to meet a necessity of printing the image on various media such as thick paper and OHP sheet.

However, papers, other than plain paper, such as paper containing paper powder in a large amount and surface-roughened paper are liable to roughen the photosensitive drum surface. For that reason, this causes a lowering in lifetime of the photosensitive drum 1. Further, the thick paper, the OHP sheet and the like are liable to damage the photosensitive drum 1 when contacting the photosensitive drum 1.

In this embodiment, by narrowing the width of the contact nip N in the boundary region D between the sheet-passing portion and the non-sheet-passing portion, the generation of the electric discharge in the region of the contact nip N was suppressed in the boundary region D between the sheet-passing portion and the non-sheet-passing portion. For this reason, it becomes possible to reduce the photosensitive drum abrasion amount in the boundary region D between the sheet-passing portion and the non-sheet-passing portion, so that it is possible to meet the various media such as the thick paper and the OHP sheet.

<Seventh Embodiment>

In the Fourth Embodiment, the outer diameter of the charging roller 2 is changed with respect to the longitudinal direction. On the other hand, in this embodiment, the charging roller outer diameter is not changed with respect to the longitudinal direction. In place thereof, this embodiment is characterized in that a charging roller 21 is provided so that a rotational axis q of the photosensitive drum 1 and a rotational axis p of the charging roller 21 contact each other with a crossing angle θ.

In this embodiment, an outer diameter Rc of the charging roller 21 formed in a straight shape with no crown was set at 10.12 mm, and the crossing angle θ was set in a range of 0 (degrees)<θ<5 (degrees).

At the end portions, when an angle at which the nip with the photosensitive drum 1 can be maintained is excessively large, the charging roller 21 cannot contact the photosensitive drum 1 and thus cannot electrically charge the photosensitive drum 1. Therefore, the crossing angle θ is larger than 0 degrees and is not more than an angle at which the charging roller 21 is contactable with the photosensitive drum 1 at the longitudinal end portions.

Figure 17:
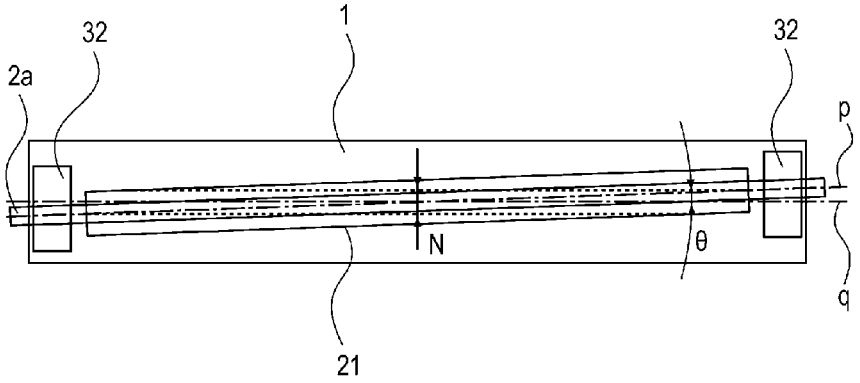
FIG. 17 is a schematic view showing a structure of the charging roller.

FIG. 17 is a schematic longitudinal arrangement view of the charging roller 21 and the photosensitive drum 1.

As shown in the figure, the rotational axis p of the charging roller 21 crosses the rotational axis q of the photosensitive drum 1 at a predetermined crossing angle θ when the rotational axis q of the photosensitive drum 1 is seen from the rotational axis p side. Further, the rotational axis p crosses the rotational axis q at a longitudinal central portion, of the width of the contact nip N, defined by indicated dotted lines. Other constitutions are the same as those in the Fourth Embodiment.

In this embodiment, the air gap G in the region of the contact nip N between the charging roller 21 and the photosensitive drum 1 was 10 μm at both the central portion and the end portions, and the width of the contact nip N was 700 μm at the central portion and was 400 μm at the end portions.

In the case where the charging roller is formed in the crown shape, the electroconductive elastic layer of the charging roller is abraded to generate cut powder, and therefore a manufacturing cost is expensive. In this embodiment, the predetermined crossing angle θ is provided between the rotational axis q of the photosensitive drum 1 and the rotational axis p of the straight-shaped charging roller 21, whereby the width of the contact nip N at the end portions is narrowed, so that the generation of the electric discharge in the region of the contact nip N at the end portions was suppressed.

Thus, the abrasion amount of the photosensitive drum at the electric discharges can be reduced, so that it is possible to reduce the manufacturing cost of the charging roller.

Incidentally, in this embodiment, the abrasion amount of the photosensitive drum at the end portions is reduced. However, e.g., by adjusting the crossing angle θ, as described in the Fifth and Sixth Embodiments, even in the boundary region between the sheet-passing portion and the non-sheet-passing portion, a similar effect can be obtained by applying the present invention.

<Eighth Embodiment>

In Fourth Embodiment, the surface shape of the charging roller 2 is the projected shape. On the other hand, this embodiment is characterized in that the surface shape of a charging roller 22 is a recessed shape.

Figure 18:
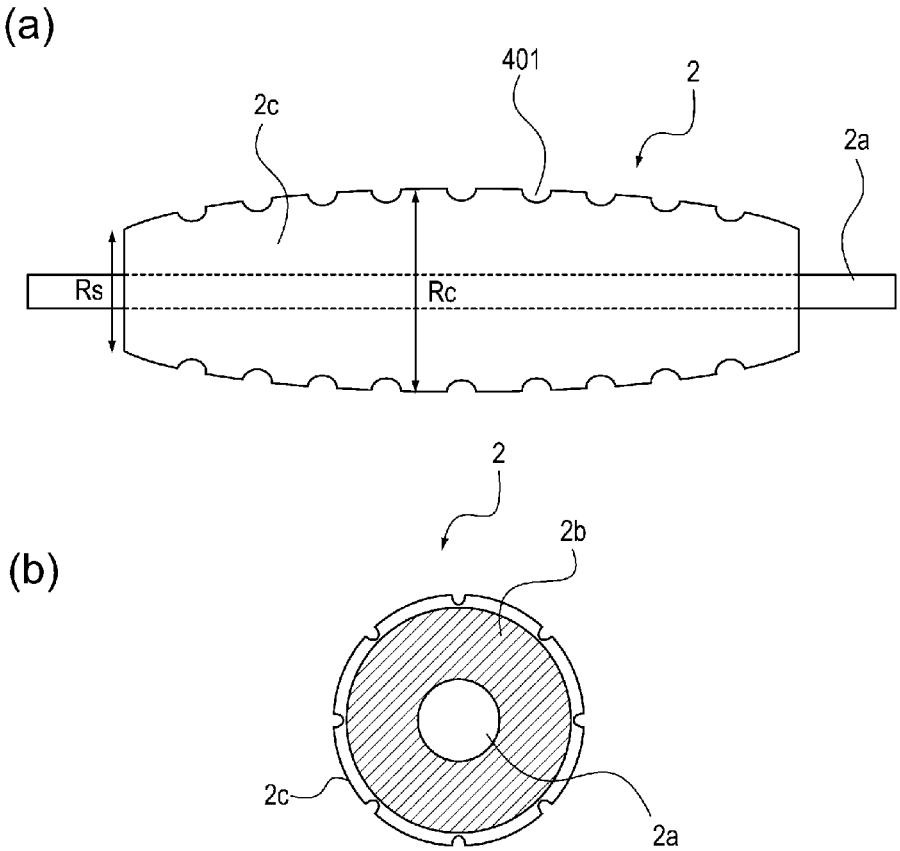
In FIG. 18, (a) and (b) are schematic views showing a structure of a charging roller, in which (a) is the schematic view showing a shape of the charging roller, and (b) is a cross-sectional view of the charging roller.

In FIG. 18, (a) and (b) are schematic views showing a structure of the charging roller 22, in which (a) is the schematic view showing the shape of the charging roller 22, and (b) is a cross-sectional view of the charging roller 22.

As shown in (a) and (b) of FIG. 18, the charging roller 22 is provided with a plurality of minute recessed portions 401 at a surface thereof. By these (plurality of) minute recessed portions 401, the surface layer of the charging roller 22 is provided with the projected and recessed portions.

Figure 19:
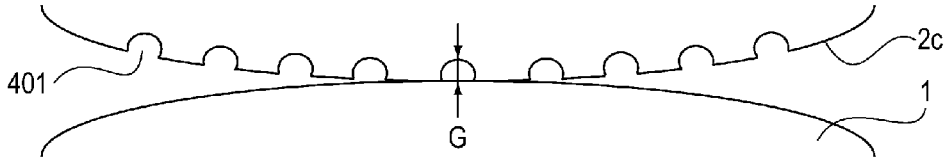
In FIG. 19, (a) and (b) are enlarged schematic views showing a contact nip region portion between the charging roller in an Eighth Embodiment shown in FIG. 18 and a photosensitive drum, in which (a) shows a contact nip region at a longitudinal central portion, and (b) shows the contact nip region at a longitudinal end portion.
Figure 19:
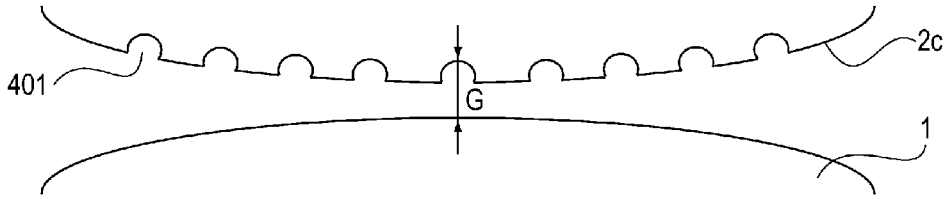

In FIG. 19, (a) and (b) are enlarged schematic views showing a region portion of the contact nip N between the charging roller 22 and the photosensitive drum 1, in which (a) shows the region of the contact nip N at a longitudinal central portion, and (b) shows the region of the contact nip N at a longitudinal end portion. A region sandwiched between adjacent two minute recessed portions 401 is a portion (projected portion) projected relative to the minute recessed portions 401, and this portion (projected portion) contacts the photosensitive drum 1 to be elastically deformed.

In FIG. 19, an upper side shows the surface of the charging roller 22, and a lower side shows the surface of the photosensitive drum 1.

The surface shape of the charging roller 2 described in the Fourth Embodiment is the projected shape, and thus the charging roller 2 is contacted to the photosensitive drum 1 in a point contact manner, and therefore the charging roller 2 is liable to be contaminated by deposition of the toner particles and the external additive on the charging roller 2 in long-term use. Accordingly, in some cases, it is difficult to continuously maintain, for a long term, the air gap formed between the charging roller 2 and the photosensitive drum 1.

Here, a correlation between the contamination and the surface shape of the charging roller will be described. For example, in the case where a contaminant is positioned downstream of the cleaning blade 8 and upstream of the charging roller 2 with respect to a driving direction, the contaminant is transferred onto the charging roller 2 during the image forming process, so that the contaminant is deposited on the surface of the charging roller 2 in some cases.

Specifically, during the rotational drive of the photosensitive drum 1, in the case where a part of the transfer residual toner having passed through the cleaning blade 8 and a fine-particle contamination such as other fine particles are deposited on the charging roller 2 disposed in contact with the photosensitive drum 1, contamination of the charging roller 2 with the fine particles occurs.

A deposition property of the fine-particle contaminant on the charging roller 2 is explained by a scraping-off effect at the surface of the charging roller 2. That is, at the surface projected and recessed portions of the charging roller 2, the fine-particle contaminant is scraped off from the photosensitive drum 1 at the projected portions, and deposition of the contaminant is generated at the recessed portions. In the case where attention is paid to this phenomenon, as a measure to decreasing the scraping-off effect at the surface of the charging roller 2, as shown in FIGS. 18 and 19, the surface shape of the charging roller 2 is changed to the recessed shape, whereby a degree of the fine-particle contamination can be alleviated.

Figure 20:
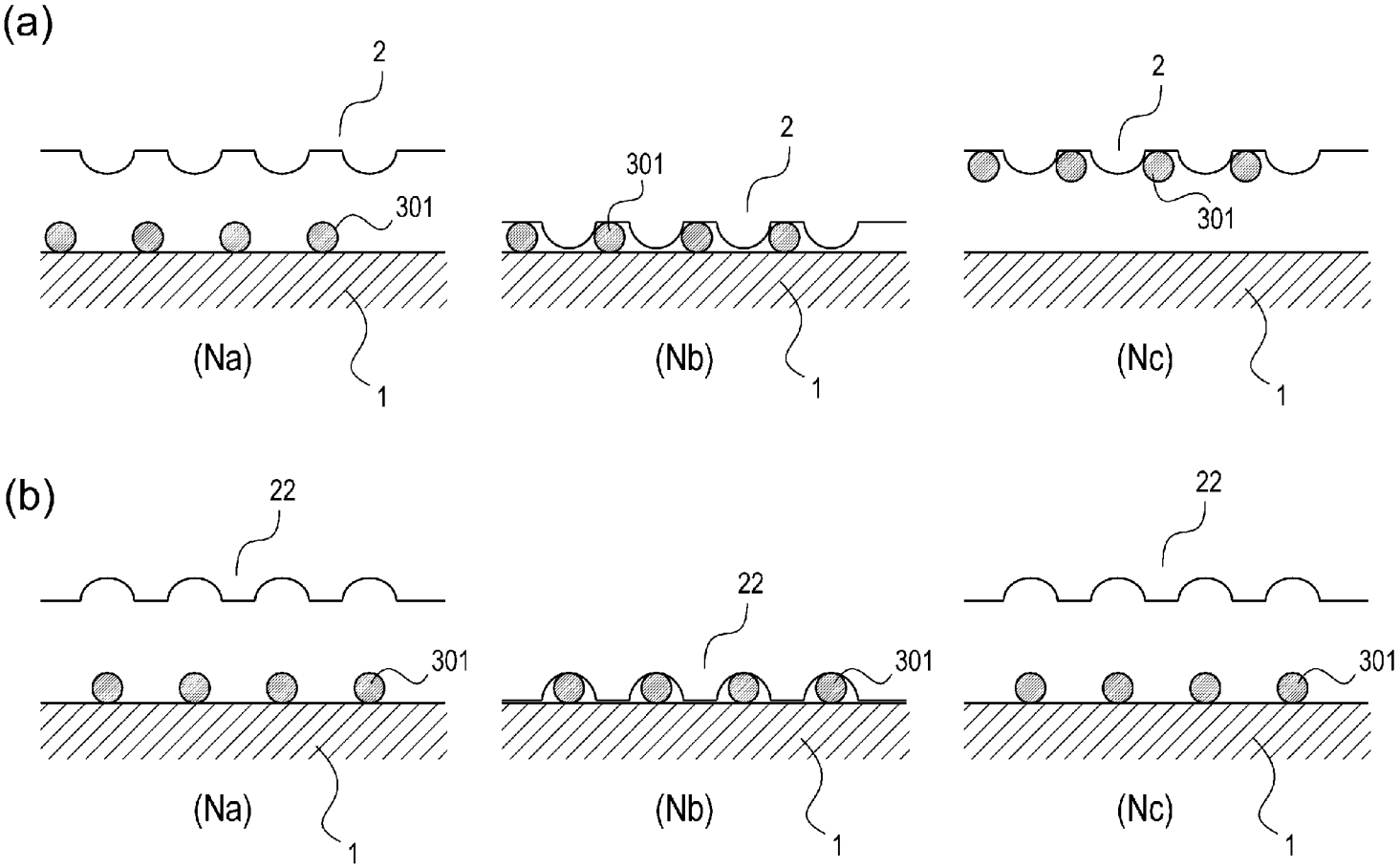
In FIG. 20, (a) and (b) are schematic views showing an effect of the Eighth Embodiment shown in FIG.18.

In FIG. 20, (a) and (b) are schematic views of the charging roller 2 in the neighborhood of the region of the contact nip N during rotational drive of the photosensitive drum 1 when the recessed-shaped charging roller 22 is used, and are schematic views showing behavior of a fine-particle contaminant 301.

In FIG. 20, (a) shows the charging roller 2 having the projected shape as the surface shape, and (b) shows the charging roller 22 having the recessed shape as the surface shape. In FIG. 20, an upper side shows the surface of the charging roller, and a lower side shows the surface of the photosensitive drum 1. Further, (Na), (Nb) and (Nc) show the cases of before passing through the region of the contact nip N, during passing through the region of the contact nip N and after passing through the region of the contact nip N, respectively.

As shown in FIG. 20, in the case of the charging roller 2 of which surface shape is the projected shape, the scraping-off effect is large, so that the fine-particle contaminant 301 is liable to be deposited on the charging roller 2. However, in the case of the charging roller 22 of which surface shape is the recessed shape, the scraping-off effect is small, so that the fine-particle contaminant 301 is not readily deposited on the charging roller 22.

Accordingly, by using the charging roller 22 of which surface shape is changed to the recessed shape, the surface of the charging roller 22 is not readily contaminated, so that it becomes possible to continuously maintain, for a long term, the air gap formed between the charging roller 22 and the photosensitive drum 1. That is, by using the charging roller 22 having the recessed shape as the surface shape thereof, the generation of the moire can be continuously suppressed even when the charging roller 22 is used for a long term.

Incidentally, in this embodiment, the charging member is provided with the surface layer, but is not limited thereto. For example, even when the surface layer is removed, by subjecting the electroconductive elastic layer to curing, if the charging member is capable of retaining the surface shape described in this embodiment, a similar effect can be obtained by applying the present invention.

Further, the charging member in the present invention is not limited to those described in the above-described embodiments, but the surface shapes of the charging members shown in the figures are an example. If the surface shape of the charging member falls within the range of not deviating from the purport of the present invention, it is also possible to employ other embodiments, applied embodiments, modified embodiments and combinations of these embodiments.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 137917/2013 filed Jul. 1, 2013, 138746/2013 filed Jul. 2, 2013 and 104247/2014 filed May 20, 2014, which are hereby incorporated by reference.

What is claimed is:

1. A charging device for electrically charging a photosensitive member, comprising:

a charging member for electrically charging the photosensitive member by being supplied with a voltage; and a supporting member for supporting said charging member so as to press-contact to the photosensitive member, wherein said charging member comprises:

an electroconductive support;

an elastic base layer supported by said electroconductive support; and an elastic surface layer, provided on a surface of said elastic base layer, being harder than said elastic base layer;

wherein said elastic surface layer is provided with projected portions and recessed portions, and wherein the projected portions are elastically deformable in contact with the photosensitive member, leaving electrically dischargeable gaps between the recessed portions of said elastic surface layer and the photosensitive member.

2. A charging device according to claim 1, wherein a width of a region where said charging member press-contacts to the photosensitive member is larger at a longitudinal central portion than at a longitudinal end portion of the photosensitive member.

3. A charging device according to claim 2, wherein a penetration amount of said charging member into the photosensitive member is larger at the longitudinal central portion than at the longitudinal end portion of the photosensitive member.

4. A charging device according to claim 2, wherein said charging member has a crown shape.

5. A charging device according to claim 2, wherein said charging member press-contacts to the photosensitive member so that a rotational axis of the charging member intersects with a rotational axis of the photosensitive member at a crossing angle.

6. A charging device according to claim 2, further comprising a cleaning member for cleaning a surface of the photosensitive member, wherein a contact pressure between said cleaning member and the photosensitive member is larger at the longitudinal end portion than at the longitudinal central portion of the photosensitive member.

7. A charging device according to claim 2, wherein the width is smaller in a non-image forming region where a developer image is not formed on a surface of the photosensitive member than in an image forming region where the developer image is formed on the surface of the photosensitive member.

8. A charging device according to claim 2, wherein the width is smaller at a boundary portion, between a region where a recording material is not fed and a region where the recording material is fed, than at the central portion of the photosensitive member.

9. A charging device according to claim 1, wherein the projected portions are formed by incorporating particles into said elastic surface layer.

10. A charging device according to claim 1, wherein said elastic base layer is constituted by a foam member, and wherein the projected portions and recessed portions of said elastic surface layer are such that a surface shape of the foam member appears at a surface of said charging member via said elastic surface layer.

11. A charging device according to claim 1, wherein the projected portions and recessed portions are left by providing said elastic surface layer with the recessed portion by subjecting said elastic surface layer to etching.

12. A charging device according to claim 1, further comprising an urging member for urging said charging member toward the photosensitive member.

13. A charging device according to claim 1, wherein said charging member is a rotatable roller member.

14. A charging device according to claim 1, wherein said charging member has a ten point average roughness Rz (μm) in a range of $15 \leq Rz \leq 50$, and has a surface hardness in a range of 50 degrees or more and 85 degrees or less in terms of MD-1 hardness.

15. A charging device according to claim 1, wherein said charging member has a surface hardness in a range of 60 degrees or more and 90 degrees or less in terms of Asker C hardness.

16. A charging device according to claim 1, wherein said elastic surface layer has been subjected to curing using any one of heat, light irradiation and electron beam irradiation.

17. A charging device according to claim 1, wherein a thickness of said elastic surface layer is smaller than 1/100 of a thickness of said elastic base layer and is larger than $7.7\times10^{-6}$ m.

18. An image forming apparatus for forming an image on a recording material, comprising:

a photosensitive member;

a charging member for electrically charging the photosensitive member by being supplied with a voltage;

a supporting member for supporting said charging member so as to press-contact to the photosensitive member; and a power source for applying a voltage to said charging member, wherein said charging member comprises:

an electroconductive support;

an elastic base layer supported by said electroconductive support; and an elastic surface layer, provided on a surface of said elastic base layer, being harder than said elastic base layer;

wherein said elastic surface layer is provided with projected portions and recessed portions, and wherein the projected portions are elastically deformable in contact with the photosensitive member, leaving electrically dischargeable gaps between the recessed portions of said elastic surface layer and the photosensitive member.

19. A image forming apparatus according to claim 18, wherein a width of a region where said charging member press-contacts to the photosensitive member is larger at a longitudinal central portion than at a longitudinal end portion of the photosensitive member.

20. A charging device for electrically charging a photosensitive member, comprising:

a charging member for electrically charging the photosensitive member by being supplied with a voltage; and a supporting member for supporting said charging member so as to press-contact to the photosensitive member, wherein said charging member comprises:

an electroconductive support;

an elastic base layer supported by said electroconductive support; and an elastic surface layer, provided on a surface of said elastic base layer, being harder than said elastic base layer;

wherein said elastic surface layer is provided with projected portions and recessed portions, and wherein the projected portions are elastically deformable in contact with the photosensitive member, leaving gaps between the recessed portions of said elastic surface layer and the photosensitive member, wherein when a potential difference between a surface of said charging member and a surface of the photosensitive member is V (V), an urging force for urging said charging member toward the photosensitive member is P (N), a height of the projected portions before deformation is L (m), the sum of contact areas where the projected portions contact the photosensitive member is S (m2), and Young's modulus when said elastic base layer and said elastic surface layer are deformed is E (MPa), these parameters satisfy the following relationship:

$$((V-312)/6.2)\times10^{-6}(m)>L(1-P/ES)>7.7\times10^{-6}(m).$$

21. A charging device according to claim 20, wherein said charging member has a ten point average roughness Rz (μm) in a range of $15\leq Rz\leq50$, and has a surface hardness in a range of 50 degrees or more and 85 degrees or less in terms of MD-1 hardness.

22. A charging device according to claim 20, wherein said charging member has a surface hardness in a range of 60 degrees or more and 90 degrees or less in terms of Asker C hardness.

23. A charging device according to claim 20, wherein said elastic surface layer has been subjected to curing using any one of heat, light irradiation and electron beam irradiation.

24. A charging device according to claim 20, wherein a thickness of said elastic surface layer is smaller than 1/100 of a thickness of said elastic base layer and is larger than $7.7\times10^{-6}$ m.

25. An image forming apparatus for forming an image on a recording material, comprising:

a photosensitive member;

a charging member for electrically charging the photosensitive member by being supplied with a voltage;

a supporting member for supporting said charging member so as to press-contact to the photosensitive member; and a power source for applying a voltage to said charging member, wherein said charging member comprises:

an electroconductive support;

an elastic base layer supported by said electroconductive support; and an elastic surface layer, provided on a surface of said elastic base layer, being harder than said elastic base layer;

wherein said elastic surface layer is provided with projected portions and recessed portions, and wherein the projected portions are elastically deformable in contact with the photosensitive member, leaving gaps between the recessed portions of said elastic surface layer and the photosensitive member, wherein when a potential difference between a surface of said charging member and a surface of the photosensitive member is V (V), an urging force for urging said charging member toward the photosensitive member is P (N), a height of the projected portions before deformation is L (m), the sum of contact areas where the projected portions contact the photosensitive member is S (m2), and Young's modulus when said elastic base layer and said elastic surface layer are deformed is E (MPa), these parameters satisfy the following relationship:

$$((V-312)/6.2)\times10^{-6}(m)>L(1-P/ES)>7.7\times10^{-6}(m).$$

26. An image forming apparatus according to claim 25, wherein said charging member has a ten point average roughness Rz (μm) in a range of $15\leq Rz\leq50$, and has a surface hardness in a range of 50 degrees or more and 85 degrees or less in terms of MD-1 hardness.

27. An image forming apparatus according to claim 25, wherein said charging member has a surface hardness in a range of 60 degrees or more and 90 degrees or less in terms of Asker C hardness.

28. An image forming apparatus according to claim 25, wherein said elastic surface layer has been subjected to curing using any one of heat, light irradiation and electron beam irradiation.

29. An image forming apparatus according to claim 25, wherein a thickness of said elastic surface layer is smaller than 1/100 of a thickness of said elastic base layer and is larger than $7.7\times10^{-6}$ m.

* * * * *